US009743696B1

(12) United States Patent
Ramsey

(10) Patent No.: US 9,743,696 B1
(45) Date of Patent: Aug. 29, 2017

(54) ILLUMINATING UNDERGARMENT AND METHOD OF USE

(71) Applicant: Jami Rose Ramsey, Odessa, FL (US)

(72) Inventor: Jami Rose Ramsey, Odessa, FL (US)

( * ) Notice: Subject to any disclaimer, the term of this patent is extended or adjusted under 35 U.S.C. 154(b) by 0 days.

(21) Appl. No.: 15/297,098

(22) Filed: Oct. 18, 2016

Related U.S. Application Data

(63) Continuation-in-part of application No. 14/276,016, filed on May 13, 2014, now Pat. No. 9,470,411.

(60) Provisional application No. 61/827,589, filed on May 25, 2013.

(51) Int. Cl.

| | |
|---|---|
| ***F21V 21/08*** | (2006.01) |
| ***A41D 27/08*** | (2006.01) |
| ***A41B 9/10*** | (2006.01) |
| ***A41B 9/06*** | (2006.01) |
| ***A41B 9/00*** | (2006.01) |
| ***A41D 27/20*** | (2006.01) |
| ***A41B 9/08*** | (2006.01) |
| ***F21V 33/00*** | (2006.01) |
| ***F21L 2/00*** | (2006.01) |
| ***F21V 23/00*** | (2015.01) |
| ***F21V 29/15*** | (2015.01) |
| *F21V 21/096* | (2006.01) |

(52) U.S. Cl.
CPC ..... *A41D 27/085* (2013.01); *A41B 9/001* (2013.01); *A41B 9/06* (2013.01); *A41B 9/08* (2013.01); *A41B 9/10* (2013.01); *A41D 27/20* (2013.01); *F21L 2/00* (2013.01); *F21V 21/08* (2013.01); *F21V 23/003* (2013.01); *F21V 29/15* (2015.01); *F21V 33/0008* (2013.01); *F21V 21/0816* (2013.01); *F21V 21/0832* (2013.01); *F21V 21/0965* (2013.01)

(58) Field of Classification Search
CPC ..... A41B 9/00; A41B 9/001; A41B 9/002; A41B 9/004; A41B 9/005; A41B 9/007; A41B 9/008; A41B 9/02; A41B 9/023; A41B 9/026; A41B 9/04; A41B 9/06; A41B 9/08; A41B 9/10; A41B 9/12; A41B 9/14; A41B 9/16; A41B 2400/00; F21V 33/0008
USPC ..... 362/103, 108, 457–458
See application file for complete search history.

(56) References Cited

U.S. PATENT DOCUMENTS

| | | | |
|---|---|---|---|
| 4,164,008 | A | 8/1979 | Miller et al. |
| 4,480,293 | A | 10/1984 | Wells |
| 4,570,206 | A | 2/1986 | Deutsch |
| 4,709,307 | A | 11/1987 | Branom |

(Continued)

*Primary Examiner* — Jason Moon Han
(74) *Attorney, Agent, or Firm* — Allen D. Hertz, P. A.; Allen D. Hertz

(57) ABSTRACT

An illuminating undergarment carries a series of illuminating devices for emitting light and presenting a glow from underneath an outer garment. The undergarment can be tailored in any suitable form factor, such as a slip for placement under a skirt or skirt portion of a dress or other form factors for use under dresses, blouses, pants, etc. The undergarment comprises a series of illuminating device retention members affixed to a surface of the undergarment body. The undergarment body can be sectioned into segments, enabling changes in length and/or shape. The illuminating devices are removably attached to the undergarment by the retention members. The illuminating devices can be arranged in a random pattern, a pattern representing an object, a pattern representing text, etc. and any combination thereof. The illuminating devices can be powered by a portable power supply and controlled by a circuit and/or a switch.

20 Claims, 13 Drawing Sheets

(56) References Cited

U.S. PATENT DOCUMENTS

| | | | |
|---|---|---|---|
| 5,113,325 | A | 5/1992 | Eisenbraun |
| 5,278,734 | A | 1/1994 | Ferber |
| 5,440,461 | A | 8/1995 | Nadel et al. |
| 7,878,675 | B2 | 2/2011 | Finn |
| 2003/0213044 | A1 | 11/2003 | Wilkinson et al. |
| 2010/0251453 | A1 | 10/2010 | Chen |

ILLUMINATING UNDERGARMENT AND METHOD OF USE

CROSS REFERENCE TO RELATED APPLICATIONS

This application is a Non-Provisional Utility Application, Which is a Continuation-In-Part claiming the benefit of U.S. Non-Provisional Utility application Ser. No. 14/276,016, filed on May 13, 2014 (scheduled to issue as U.S. Pat. No. 9,470,411 on Oct. 18, 2016), which claims the benefit of U.S. Provisional Patent Application Ser. No. 61/827,589, filed on May 25, 2013, which is incorporated by reference herein in its entirety.

FIELD OF THE INVENTION

The present disclosure generally relates to an undergarment. More particularly, the present disclosure relates to an undergarment comprising a plurality of illuminating elements, preferably having each placed illuminating element inserted within a pocket to illuminate a dress, skirt, and the like.

BACKGROUND OF THE INVENTION

Individuals strive to present themselves in a particular image. The person's image can vary in many ways, including a memorable tone, a concealing tone, a unique tone, a dressy tone, a casual tone, a sexy tone, and the like. Various components contribute to the person's image, including makeup, hairstyle, attire, shoes, accessories, and the like.

Certain individuals attending certain events strive to make a memorable impression on others. This can include other attendees, the press, and the like. The uniqueness can be for any of a variety of reasons, including special occasions (weddings, prom, homecoming, other school event, sweet sixteen parties, quinceañera, christenings, bar mitzvah, bat mitzvah, fundraisers, awards banquets, concerts, plays, etc.), pageants, evening outings (such dancing, clubbing, concerts, etc.), and the like. Individuals that would desire to make memorable impressions can include a modern bride; a bridesmaid/bridal party; a celebrity attending an event, such as an awards ceremony; a singer or entertainer attending an event, such as the Grammys; a performer performing in a play, a theater event, a street performer, and the like; an actor or actress performing in a recorded production, such as television program, a movie, and the like; a musician performing at a gig; athletic performers, such as ice skaters; ballerinas or other dancers at a recital; cheerleaders performing at an event; and any other suitable event where the individual desires to become a key center of attention.

One manner for making a memorable impression is where an individual wears a dress or other apparel that accent or elude to certain physical properties, including legs, hips, breast line, cleavage, and the like, wherein the accents are directed towards a sexually memorable impression. This can include an outline of the garment, cutouts within the garment, slits within the garment, and the like. Portions of the garment can be open, exposing the individual's skin, utilize a nude backing material, and the like to present the desired perception.

Another manner for making a memorable impression includes a dress or other apparel having accents or other features that are unique. One example of an instance was a dress shaped as a swan. Another example was a garment tailored using fabric having a unique print. Yet another example was a jacket worn backwards.

Lights have been known to be added to various garments, whereby the lights are permanently attached to the inner surface of the fabric of the garment. This configuration limits the application of the under-lighting to the respective garment. The illuminating elements are attached to the interior of the garment in a fixed arrangement, thus introducing another limitation.

What is desired is a garment accessory enabling the wearer with the ability to illuminate any of a variety of garments. An additional benefit would be an apparatus and associated method of use enabling a user to customize an arrangement of a plurality of lights placed upon an undergarment into any specific pattern to illuminate an outer garment.

SUMMARY OF THE INVENTION

The basic inventive concept provides an undergarment having a series of illuminating device retention members attached to an exterior surface thereof.

A first aspect of the present invention provides an illuminating undergarment comprising:

- an undergarment body tailored of a fabric, the undergarment body having an undergarment material extending between an upper opening, and at least one lower opening, an orientation of the undergarment body defining an exterior surface and an interior surface;
- a plurality of illuminating device attachment elements affixed to the undergarment body exterior surface;
- at least one illuminating assembly comprising at least one illuminating element in electrical communication with a portable power supply,
- wherein the at least one illuminating assembly is removably attached to the undergarment body exterior surface by a respective illuminating device attachment element of the plurality of illuminating device attachment elements.

In a second aspect of the present invention, the upper opening defines a waistline, the at least one lower opening defines a hemline, and the undergarment material is shaped forming a skirt undergarment.

In another aspect, the upper opening defines a neckline, the at least one lower opening defines a waistline, and the undergarment material is shaped forming a blouse undergarment.

In yet another aspect, the upper opening defines one of a neckline or bust line, the at least one lower opening defines a hemline, and the undergarment material is shaped forming a dress undergarment.

In yet another aspect, the upper opening defines one of a waistline, the at least one lower opening defines a pair of hemlines, and the undergarment material is shaped forming a pant undergarment.

In yet another aspect, the garment can be shaped as a wrap, wherein the upper opening and lower opening are respective edges of the undergarment body.

In yet another aspect, the illuminating device attachment elements are provided in a form factor of a pocket.

In yet another aspect, the illuminating device attachment elements are provided in a form factor of a pocket, wherein the pocket includes stitching arranged to divide the pocket into segmented pockets.

In yet another aspect, the illuminating device attachment elements are provided in a form retention strap.

In yet another aspect, the retention straps further comprise a snap for removably affixing the illuminating assembly to the undergarment body exterior surface.

In yet another aspect, the retention straps further comprise a spiral shaped retention element for retaining the illuminating assembly to the undergarment body exterior surface. The spiral shaped retention element is looped about an electrically conductive element or wire of the illuminating assembly.

In yet another aspect, the illuminating device attachment elements are provided in a form factor of a dense hook and loop interface.

In yet another aspect, the illuminating device attachment elements are provided in a form factor of a dense hook and loop interface having the dense loop section attached to the undergarment and the dense hook section attached to the illuminating device.

In yet another aspect, the illuminating assembly is fabricated including a light emitting diode (LED) strip comprising a plurality of LED's. Although the exemplary embodiment of this aspect utilizes an LED strip, is understood that any plurality of illuminating devices can be used.

In another aspect, the illuminating devices can be fabricated using one or more light emitting diodes (LEDs), incandescent bulbs, florescent bulbs, electroluminescent subassemblies, and the like. The illuminating devices can be designed to emit different colors based upon changes of an input signal, such as multicolored LED's.

In another aspect, the illuminating system can further include fiber optics for transferring emitted light from a light source to a desired location for emission of the light.

In yet another aspect, the illuminating assembly includes an illuminating device housing, wherein the illuminating device housing carries the illuminating element. The illuminating assembly further comprises an electrical circuit communicating electrical power from the portable power supply to the illuminating device.

In yet another aspect, the illuminating assembly includes an illuminating device housing, wherein the illuminating device housing carries the portable power supply.

In yet another aspect, the illuminating electrical circuit further comprises an illumination switch, wherein the illumination switch provides operational control of the illuminating element.

In yet another aspect, the illuminating electrical circuit provides operational control each of the illuminating elements in any of the following modes:

a. a Continuous, solid light emission, b. a Flashing light emission, c. a Sequential light emission, and d. a Color changing light emission.

In yet another aspect, the illumination switch provides an operational interface with the illuminating electrical circuit to select a desired illuminating mode of operation.

In yet another aspect, the illuminating assembly includes an illuminating element assembly electrical conductor carrying a plurality of illuminating elements thereon, the illuminating element assembly electrical conductor further providing electrical communication between each of the plurality of illuminating elements and the portable power supply.

In yet another aspect, the illuminating element retention elements are attached to an exterior surface of the undergarment material in a random arrangement.

In yet another aspect, the illuminating element retention elements are attached to an exterior surface of the undergarment material in an array pattern arrangement. The array pattern can be a horizontal/vertical grid, a diagonally arranged array, and the like.

In yet another aspect, the undergarment can include a single form factor of illuminating element retention assemblies.

In yet another aspect, the undergarment can include two or more differing form factors of illuminating element retention assemblies.

In yet another aspect, illuminating undergarment can include a thermal barrier to prevent transfer of heat from the illuminating elements to the wearer. The illuminating undergarment may include a lining material to provide a function of the thermal barrier; the undergarment material may be of a thermally absorbing or thermally reflective material, and the like.

In yet another aspect, the undergarment and/or illuminating elements can be coordinated to the outer garment by shape, style, color, material, and the like.

In yet another aspect, the undergarment and/or illuminating elements can be designed or tailored for a specific event, holiday, and the like.

In yet another aspect, the undergarment can include at least two segments, wherein two adjacent edges of two adjacent segments are detachably joined together.

In yet another aspect, the undergarment can include at least two segments, wherein the inclusion of additional segments is used to enable interchangeable elements or features to the undergarment. Examples include, interchangeable sleeves, interchangeable pant legs, interchangeable skirts, interchangeable tops, to introduce a few of the many options.

In yet another aspect, the undergarment can include at least two segments, wherein the inclusion of additional segments is used to increase a length of the undergarment.

In yet another aspect, the undergarment can include at least two segments, wherein the inclusion of additional segments is used to introduce a pair of pant legs to the undergarment.

In yet another aspect, the undergarment can include at least two segments, wherein the inclusion of additional segments is used to introduce a top to the undergarment.

In yet another aspect, the undergarment can include at least two segments, wherein the inclusion of additional segments is used to introduce a skirt to the undergarment.

In yet another aspect, the undergarment can include at least two segments, wherein the inclusion of additional segments is used to introduce a pair of sleeves to the undergarment.

In yet another aspect, the undergarment can include at least two segments, wherein the inclusion of additional segments is used to increase a length of each sleeve of the undergarment.

In yet another aspect, the undergarment can include at least two segments, wherein the inclusion of additional segments is used to increase a length of each pant leg of the undergarment.

In yet another aspect, the undergarment can include at least two segments, wherein two adjacent edges of two adjacent segments are detachably joined together using at least one mechanical fastener.

In yet another aspect, the undergarment can include at least two segments, wherein two adjacent edges of two adjacent segments are detachably joined together using at least one mechanical fastener, wherein the mechanical fastener is at least one of a cording, a ribbon, a series of eyelets, a series of buttons and buttonholes, a series of snaps, a series of hooks and loops, a dense hook and loop tape, a series of segments of a dense hook and loop tape, a series of magnets and magnetically attracted material, a zipper, an adhesive, and the like, and any combination thereof.

In yet another aspect, the undergarment is provided in a form factor of a dress shaped slip.

In yet another aspect, the undergarment is provided in a form of a dress including at least one of the following features:

a) a strapless dress,
b) a halter dress,
c) a cap sleeve dress,
d) a short sleeve dress,
e) a three-quarter length sleeve dress,
f) a long sleeve dress,
g) an off-the-shoulder dress,
h) having a floor length skirt,
i) having an ankle length skirt,
j) having a calf length skirt,
k) having a knee length skirt,
l) having a thigh length skirt, and
m) having a mini skirt.

In yet another aspect, the undergarment is provided in a form of a dress or skirt including a crinoline, petticoat, or Tutu.

In yet another aspect, the undergarment is adapted to illuminate a Tutu, a pageant dress, or any other costume.

In yet another aspect, the undergarment is provided in a form of a dress including a crinoline, wherein the crinoline is fabricated having one of:

a) a floor length skirt,
b) an ankle length skirt,
c) a calf length skirt,
d) a knee length skirt,
e) a thigh length skirt, or
f) a mini skirt.

In yet another aspect, the undergarment is provided in a form factor of a skirt shaped slip.

In yet another aspect, the undergarment is provided in a form factor of one of:

a) a floor length skirt sized slip,
b) an ankle length skirt sized slip,
c) a calf length skirt sized slip,
d) a knee length skirt sized slip,
e) a thigh length skirt sized slip, and
f) a mini skirt sized slip.

In yet another aspect, the undergarment is provided in a form factor adapted for use under a shirt.

In yet another aspect, the undergarment is provided in a form factor of a top, more specifically one of:

a) a strapless top,
b) a halter top,
c) a tank top,
d) a camisole,
e) a cap sleeve top,
f) a short sleeve top,
g) a three-quarter length sleeve top,
h) a long sleeve top, or
i) an off-the-shoulder top.

In yet another aspect, the undergarment is provided in a form factor of a garment adapted for use under a pair of pants, more specifically one of:

a) full length pants,
b) ankle length pants,
c) culottes,
d) shorts,
e) short shorts,
f) capri or calf length pants, or
g) board or knee length shorts.

In yet another aspect, the undergarment is provided in a form factor of a garment resembling a unitard, including at least one of:

a) a leotard,
b) a narrow "V" shaped neckline,
c) a broad "V" shaped neckline,
d) a scoop shaped neckline,
e) a halter top shaped upper portion,
f) an off-the-shoulder shaped upper portion,
g) a single shoulder shaped upper portion,
h) a tank top shaped upper portion,
i) a camisole shaped upper portion,
j) a cap sleeve,
k) a short sleeve,
l) a three-quarter length sleeve,
m) a long sleeve,
n) a hip shaped hemline having no legs,
o) short shorts pant legs,
p) short pant legs,
q) board or knee length pant legs.
r) capri or calf length pant legs,
s) culottes pant legs,
t) ankle length pant legs, and
u) full length pant legs.

In yet another aspect, the undergarment is provided in a form factor of a tube top, the tube top extending from slightly above a bust line to a hemline slightly below the bust line.

In yet another aspect, the undergarment is provided in a form factor of a bra, wherein the bra shaped undergarment would mimic any known bra shape.

In yet another aspect, the undergarment is provided in a form factor of a panty, wherein the panty shaped undergarment would mimic any known panty shape.

In yet another aspect, the undergarment is provided in a form factor of a garment adapted for use under an outer garment, wherein the outer garment comprises at least one light permissive feature. The illuminating elements would be arranged in registration with the at least one light permissive feature of the outer garment.

In yet another aspect, the undergarment is provided in a form factor of a garment adapted for use under a pair of tuxedo pants.

In yet another aspect, the undergarment is provided in a form factor of a garment adapted for use under a pair of tuxedo pants, more specifically, having the illuminating elements or the illuminating element retention elements located along an outer seam of each pant leg, wherein the illuminating elements or the illuminating element retention elements are located in alignment with a satin ribbon of the tuxedo pants.

In yet another aspect, the undergarment is provided in a form factor of a garment adapted for use under a pair of tuxedo pants, more specifically, having the illuminating elements or the illuminating element retention elements located along an outer seam of each pant leg, wherein the illuminating elements or the illuminating element retention elements are located in alignment with a transparent or translucent ribbon located where the satin ribbon would normally run in the tuxedo pants.

In yet another aspect, the undergarment is fabricated of a stretchable material.

In yet another aspect, the undergarment is fabricated of a stretchable material and designed to be skin tight along at least a portion thereof.

In yet another aspect, the undergarment is fabricated of a stretchable material and designed to be skin tight along the entire garment.

In yet another aspect, the undergarment is fabricated of a stretchable material, wherein the stretchable material is at least one of a knit material; an elastic latex based material; an elastic latex-free material; such as SPANDEX™, LYCRA™; ELASTANE™, and the like.

In yet another aspect, the undergarment can include one or more fasteners.

In yet another aspect, the undergarment can include one or more fasteners or adjusting mechanisms, including a zipper, buttons and buttonholes, a hook and eye fastener, dense hook and loop tape, cording, and the like.

A second embodiment of the present invention provides a method of illuminating a garment, the method comprising steps of:

obtaining an illuminating undergarment, the illuminating undergarment comprising:

an undergarment body tailored of a fabric, the undergarment body having an undergarment material extending between an upper opening, and at least one lower opening, an orientation of the undergarment body defining an exterior surface and an interior surface, and a plurality of illuminating device attachment elements affixed to the undergarment body exterior surface;

obtaining at least one illuminating assembly comprising:

at least one illuminating element in electrical communication with a portable power supply;

attaching said at least one illuminating assembly to the undergarment body using a respective illuminating device attachment element of the plurality of illuminating device attachment elements;

illuminating at least a portion of the at least one illuminating element;

placing the illuminating undergarment on the wearer;

placing an outer garment on the wearer, wherein the outer garment covers the illuminating undergarment and the emitted light from each illuminated illuminating element is visible through fabric of the outer garment.

In another aspect, the method further comprises a step of attaching each of a plurality of illuminating elements to the respective illuminating device attachment elements in a pattern.

In yet another aspect, the method further comprises a step of attaching each of a plurality of illuminating elements to the respective illuminating device attachment elements in a pattern, wherein the pattern presents an image of at least one object.

In yet another aspect, the method further comprises a step of attaching each of a plurality of illuminating elements to the respective illuminating device attachment elements in a pattern, wherein the pattern presents an image of text.

In yet another aspect, the method further comprises a step of attaching each of a plurality of illuminating elements to the respective illuminating device attachment elements in a pattern, wherein the pattern presents an image of a combination of text and at least one object.

In yet another aspect, the method further comprises a step of introducing at least one of a top, a skirt, a pant leg, and a sleeve by coupling at least one appropriate segment to the undergarment.

In yet another aspect, the method further comprises a step of extending a length of at least one of the skirt, the pant leg, and the sleeve by coupling at least one appropriate segment to the undergarment.

In yet another aspect, the method further comprises a step of reducing a length of at least one of the skirt, the pant leg, and the sleeve by removing at least one appropriate segment from the undergarment.

In yet another aspect, the illuminating undergarment can be sized for use by an adult, a teenager, a child, and an infant. The undergarment can be adapted for use by a male, a female, or unisex.

In yet another aspect, the illuminating undergarment can be adapted to be worn by a pet, such as a dog, a cat, a horse, a pig, and the like.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
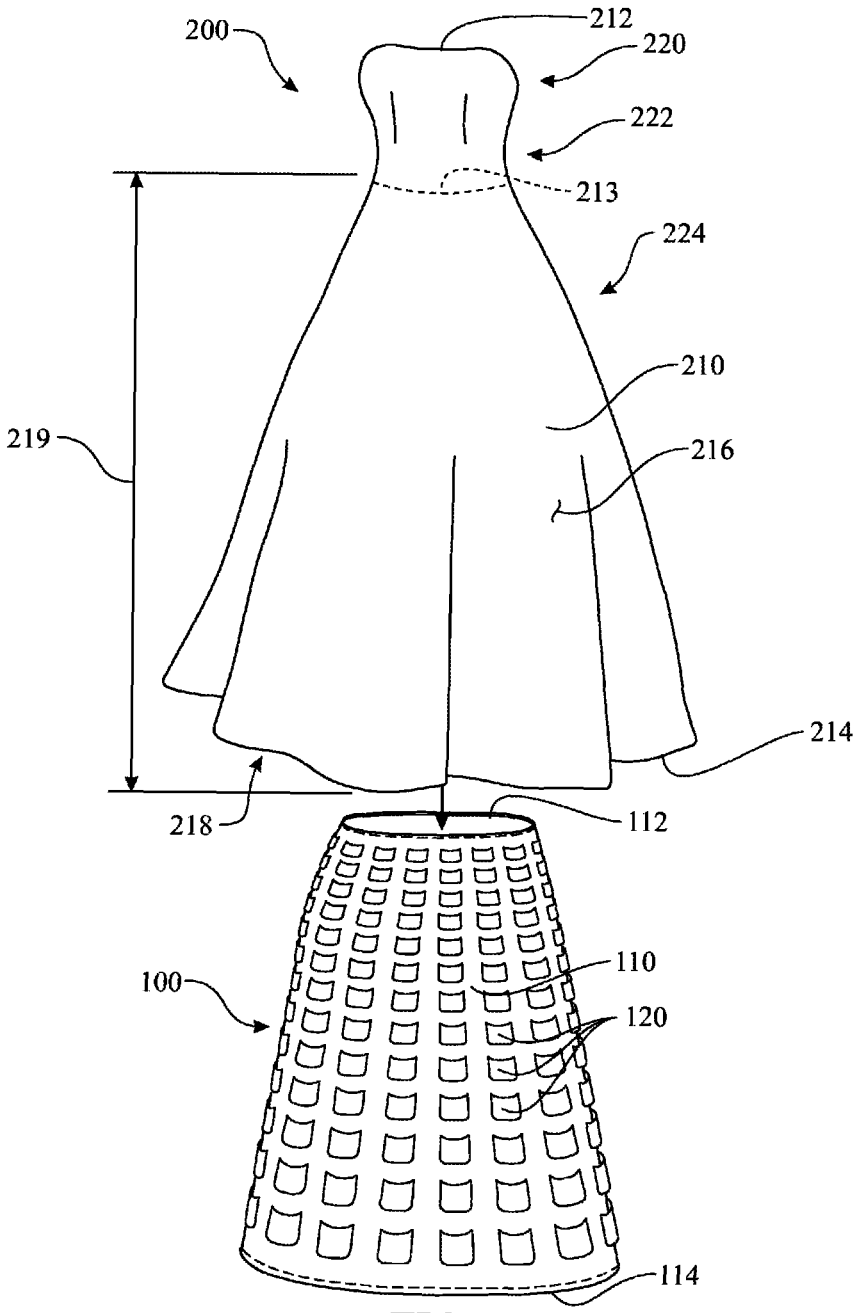
FIG. 1 presents a perspective, partially exploded assembly view of an exemplary illuminating undergarment being fitted beneath an outer garment in accordance with an exemplary embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A first exemplary illuminating undergarment 100 is described in the illustrations presented in FIGS. 1 through 5. The illuminating undergarment 100 provides a wearer 299 with the ability to illuminate a desired and suitable outer garment 200. The exemplary outer garment 200 is illustrated having a form factor of a dress or gown, comprising a bodice portion 220, a midriff portion 222, and a skirt portion 224. The outer garment 200 is tailored using any suitable garment material 210. The surfaces of the outer garment 200 can be referred to as an exposed or outer garment surface 216 and a concealed or inner garment surface 218. Other features of the outer garment 200 include an upper opening or a neckline 212 and a lower opening or a hemline 214. One dimension of note is a garment skirt length 219, wherein the garment skirt length 219 extends from a waistline 213 to the hemline 214.

Figure 3:
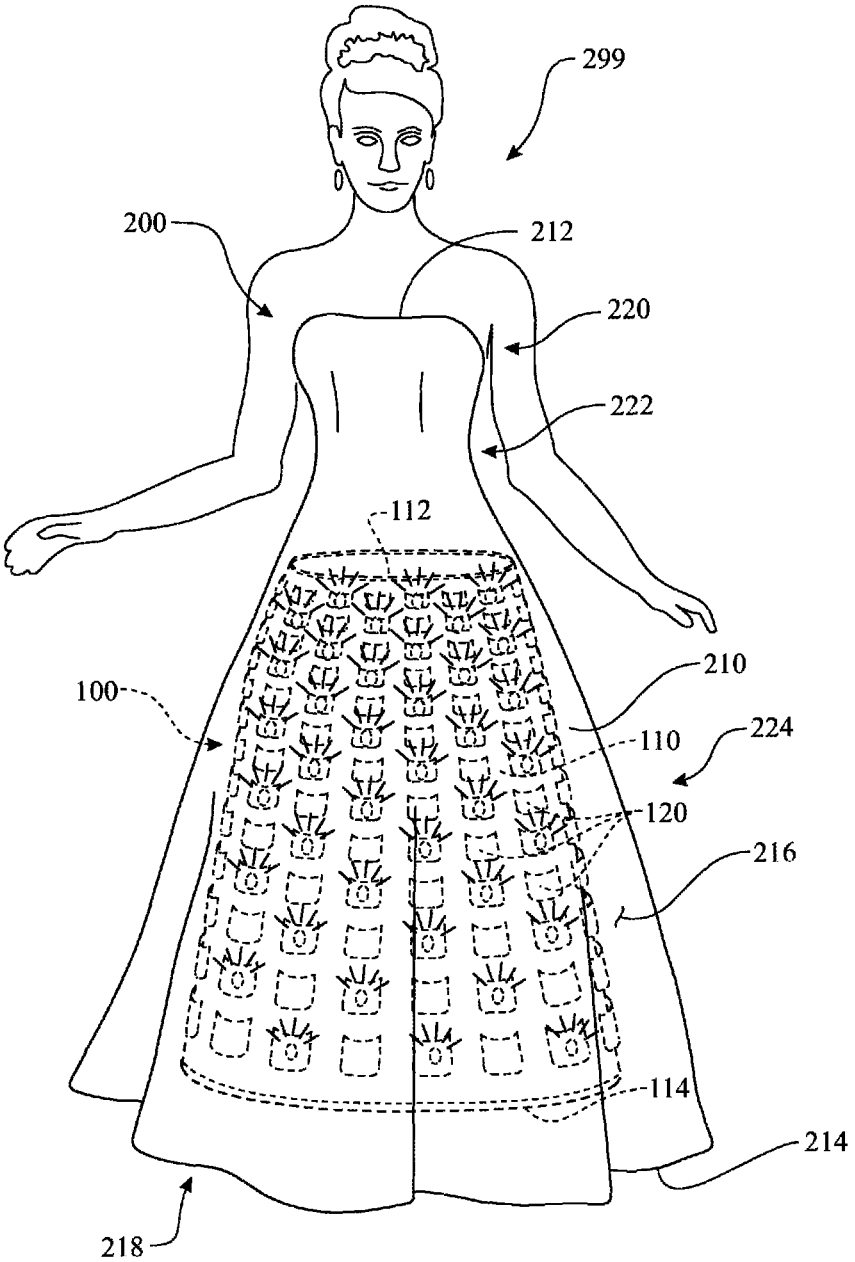
FIG. 3 presents a perspective view of the exemplary illuminating undergarment being worn beneath the outer garment, as originally introduced in FIG. 1, to exemplify an illuminating affect in a condition where the illuminating devices are operational and emitting light.

The illuminating undergarment 100 is worn underneath the outer garment 200. The illuminating undergarment 100 includes a plurality of illuminating device assemblies 130. When at least a portion of the plurality of illuminating device assemblies 130 are illuminated, the illuminated illuminating device assemblies 130 of the illuminating undergarment 100 generates a glow from within the outer garment 200, as illustrated in FIG. 3.

Figure 2:
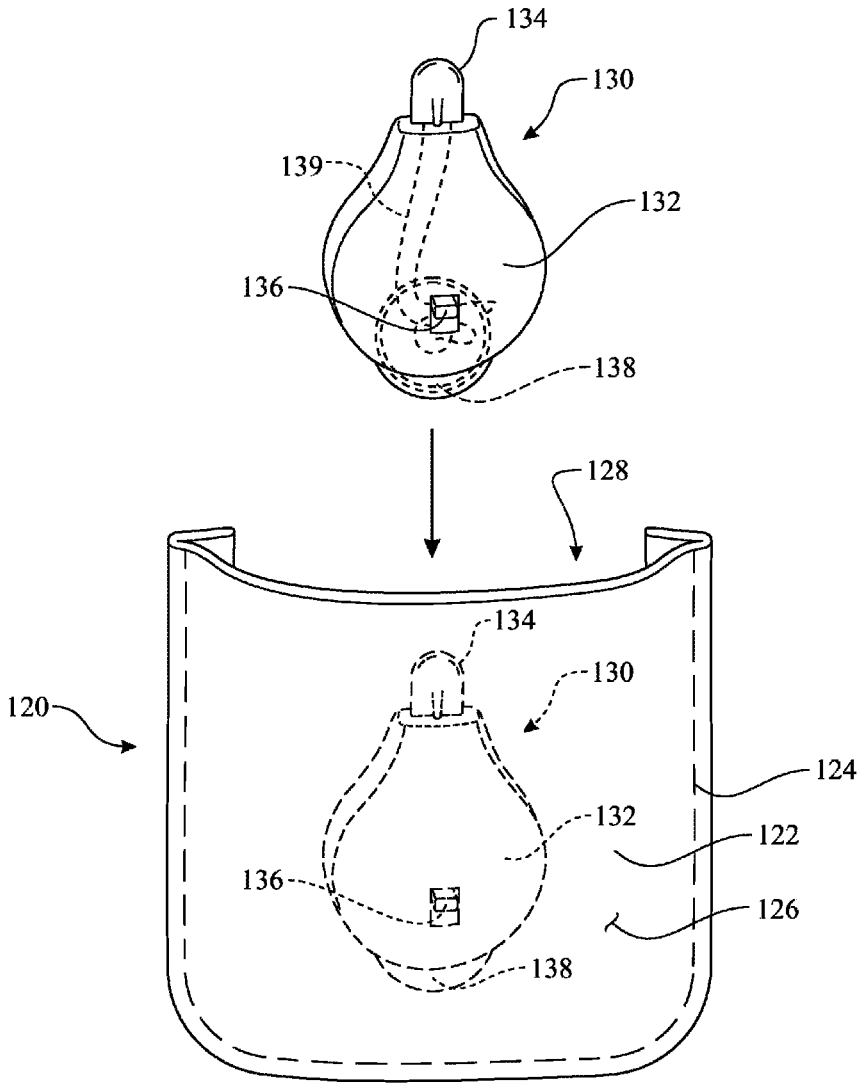
FIG. 2 presents a perspective view of an exemplary illuminating device receiving pocket having an exemplary illuminating device assembly being inserted therein.
Figure 4:
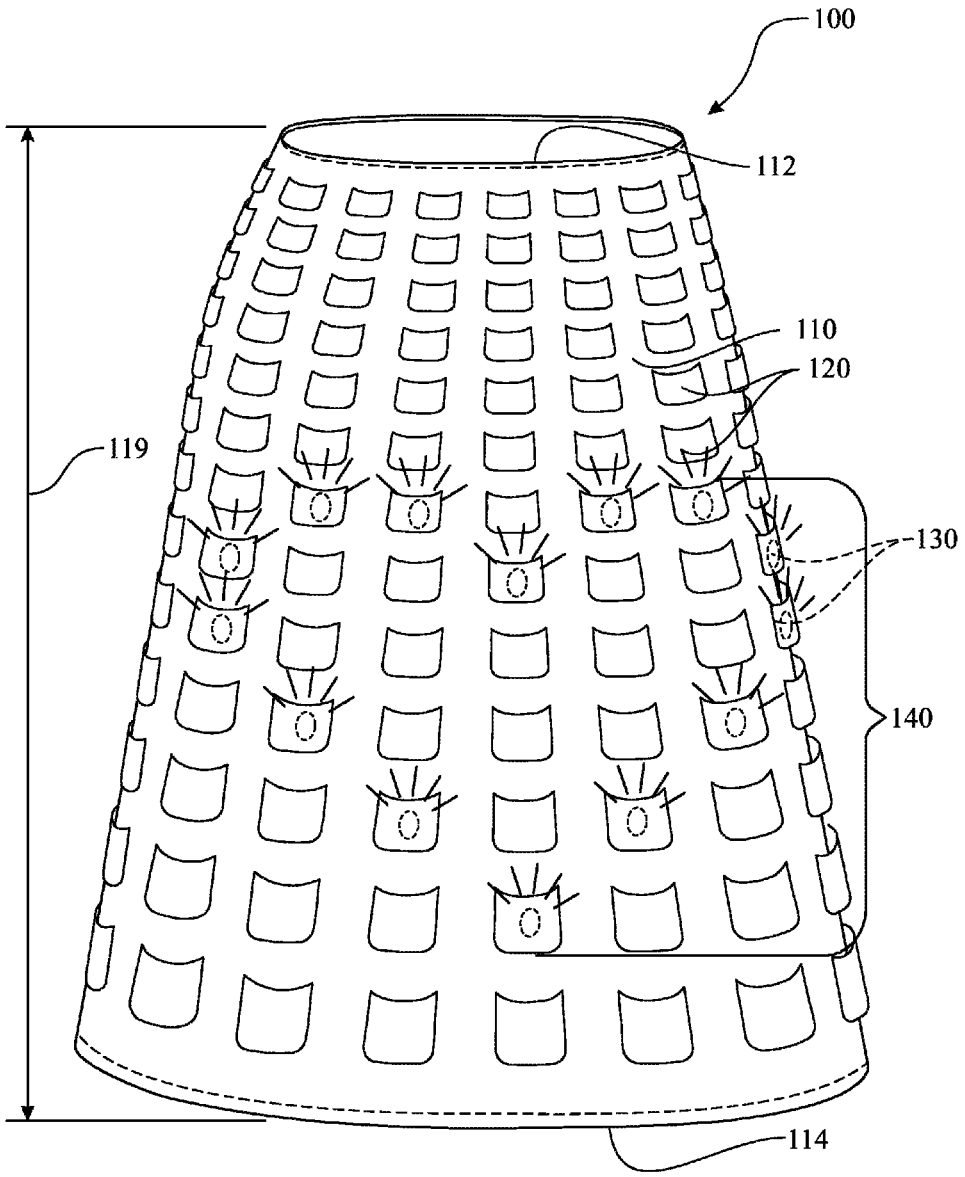
FIG. 4 presents a magnified perspective view of the exemplary illuminating undergarment as originally introduced in FIG. 1, the illustration demonstrating a method of arranging the plurality of illuminating devices in a pattern presenting an image representative of an object.

The exemplary illuminating undergarment 100 is tailored of an undergarment material 110 in a form factor of a slip, a petticoat, an underskirt, and the like. The undergarment material 110 is tailored into a tubular shape extending between an undergarment waistband 112 and an undergarment hem 114. The term tubular refers to a shape comprising an annular first end (in this case the undergarment waistband 112), an annular second end (in this case the undergarment hem 114), and material spanning between circumferential edges of the two annular ends 112, 114. It is understood that the shape can be substantially cylindrical, of a frustum, and the like. The illuminating undergarment 100 can be formed in any suitable shape, including a flaring shape (which may include crinoline), a fitted underskirt, long (for formal wear); short for minidresses, cocktail dresses, miniskirts; ball gown styles, straight for fitted dresses; mermaid style; unique styles associated with costumes, custom garments, and the like. The elongated distance spanning between the undergarment waistband 112 and the undergarment hem 114 of the illuminating undergarment 100 is referred to as an undergarment length 119 (FIG. 4). The undergarment length 119 can be any length suitable for placement underneath a desired garment. The undergarment waistband 112 can include common features associated with any waistline, including a waistband, an elastic insert, one or more fasteners (such as buttons, snaps, hook and eyes, and the like), a waistband tie, and the like. The waistband region can additionally include a vertical zipper to increase the diameter of the waistband to help the wearer 299 pull the illuminating undergarment 100 over their hips. The illuminating undergarment 100 includes a plurality of illuminating device receiving pockets 120. Each illuminating device receiving pocket 120 is fabricated of a section of pocket material 122. The pocket material 122 can be selected of any light transmissive material. The pocket material 122 for each illuminating device receiving pocket 120 is formed in any suitable shape, with the preferred shape being a rounded cornered rectangle as illustrated in FIG. 2. The edges of the material are preferably folded over as shown to provide a finished edge. The series of illuminating device receiving pockets 120 are affixed to the undergarment material 110 by any suitable process. The most common attachment process would be the use of stitching 124 about a portion of the peripheral edge of the pocket material 122, leaving an upper edge unattached. The stitching 124 and respective open upper edge creates a pocket interior 128 and respective access thereto. The series of illuminating device receiving pockets 120 are affixed to an exterior surface of the undergarment material 110 in any desired arrangement. In one arrangement, the series of illuminating device receiving pockets 120 are arranged in any desired arrangement, including a random layout, a horizontal/vertical grid or array (as illustrated), a diagonally arranged array, and the like. It is also understood that the series of illuminating device receiving pockets 120 can be arranged in any suitable predetermined pattern or a random pattern. The pattern can be representative of a phrase, an image, and the like or any combination thereof.

The illuminating undergarment 100 includes a series of illuminating device assemblies 130. Each exemplary illuminating device assembly 130 includes an illuminating element 134 supported by an illuminating device housing 132. The illuminating undergarment 100 includes an illumination circuit 139 providing electrical communication between a portable power supply 138 (wherein the portable power supply can be any suitable electrical power source, including at least one battery, at least one capacitor, a solar panel, and the like) and the illuminating element 134. The illuminating device assembly 130 can include an illumination switch 136 providing a simplistic device for controlling operation of the illuminating element 134. The portable power supply 138 can be integrated into the illuminating device housing 132 or independent thereof. The illumination switch 136 can be manually operated, motion operated, wirelessly operated, a combination thereof, and the like. The illuminating element 134 can utilize light emitting diodes (LED's), incandescent bulbs, florescent bulbs, electroluminescent elements, and the like. The illuminating devices can be selected to emit a single color or a plurality of colors. The illuminating devices can be designed to emit different colors based upon changes of an input signal, such as multicolored LED's. The illuminating device assembly 130 can include a circuit 139 enabling the illuminating device assemblies 130 to emit a solid continuous light pattern, a flashing light pattern, a sequential light pattern, a color changing light pattern, and the like. It is understood that the illuminating device housing 132 can be designed in any form factor, size, and shape suitable for the desired application.

The wearer 299 (or other individual) determines the desired arrangement of placement of the illuminating device assemblies 130 within the illuminating undergarment 100. The illuminating device assemblies 130 can be arranged in a random pattern, as illustrated in FIG. 3; a pattern representing an object or geometric design, and the like, as illustrated in FIG. 4; a pattern representing text or a combination of text and an object or geometric design, and the like, as illustrated in FIG. 5; and the like.

The series of illuminating device assemblies 130 can be arranged in a pattern representing an object or geometric design, and the like, as illustrated in FIG. 4. The exemplary arrangement presents an illuminated image 140 in a pattern of a heart.

Figure 5:
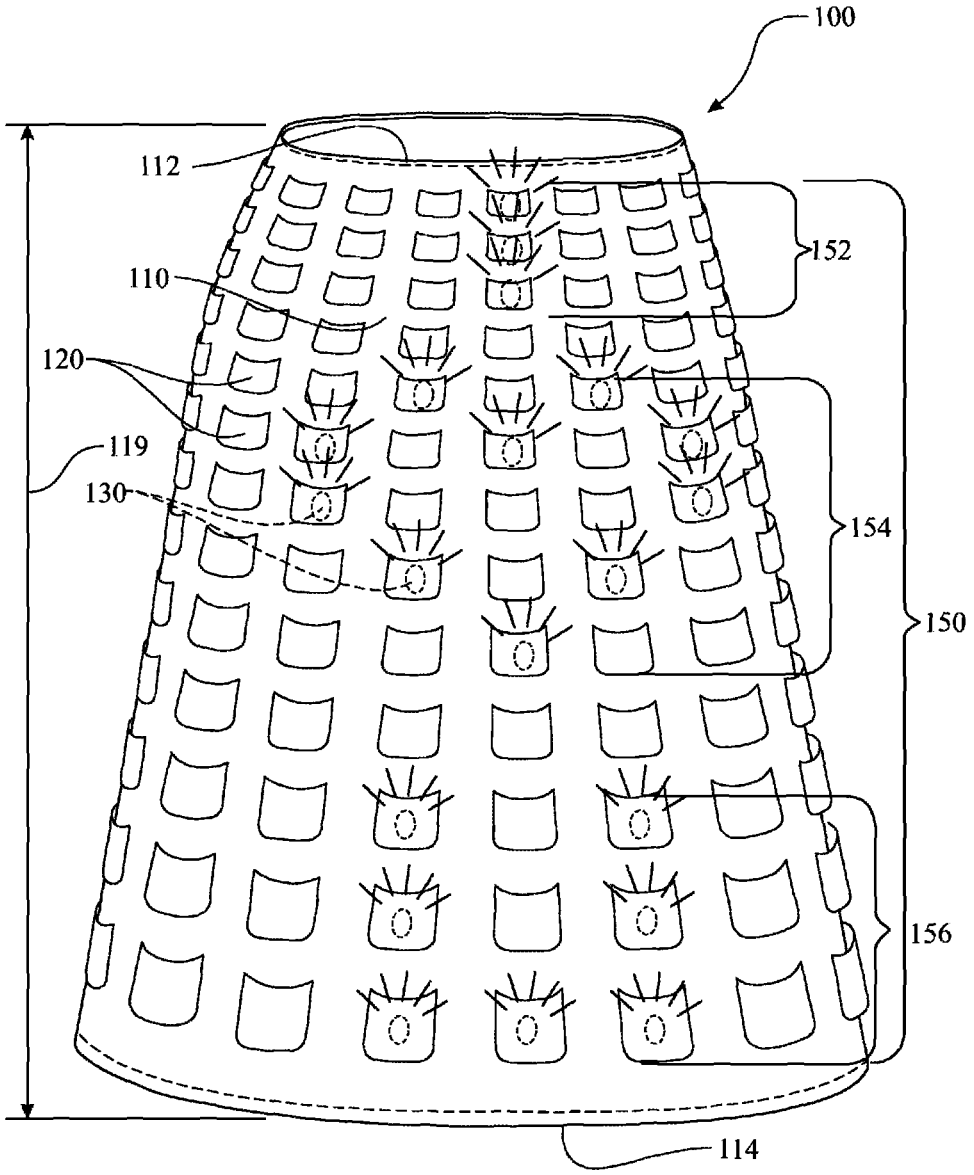
FIG. 5 presents a magnified perspective view of the exemplary illuminating undergarment as originally introduced in FIG. 1, the illustration demonstrating a method of arranging the illuminating devices in a pattern presenting an image representative of a combination of an object and text.

The series of illuminating device assemblies 130 can be arranged in a pattern representing text or a combination of text and an object or geometric design, and the like, as illustrated in FIG. 5. The exemplary arrangement presents an illuminated message 150 in a pattern of a three segment message stating "I LOVE YOU". The first illuminated message segment 152 presents an illuminated image of an "I". The second illuminated message segment 154 presents an illuminated image of a "heart" representing "love". The third illuminated message segment 156 presents an illuminated image of a "U" representing "you". Collectively, the first illuminated message segment 152, second illuminated message segment 154, and third illuminated message segment 156 form the illuminated message 150. It is understood that the user can arrange the series of illuminating device assemblies 130 in any desired pattern. It is also understood that one illuminating device assembly 130 can be placed in every illuminating device receiving pockets 120, wherein only a portion of the illuminating device assemblies 130 are illuminated to create the desired pattern.

The illuminating undergarment 100 can include a thermally insulating feature to insulate the wearer 299 from any heat generated by the series of illuminating device assemblies 130. The thermally insulating feature can be the use of thermally insulating material for the undergarment material 110, including a thermally insulating material behind the undergarment material 110 when fabricating the illuminating undergarment 100, inserting a thermally insulating material within at least a portion of the illuminating device receiving pockets 120 of the series of illuminating device receiving pockets 120, and the like. The illuminating device assembly 130 would be placed external of the thermally insulating material.

Figure 6:
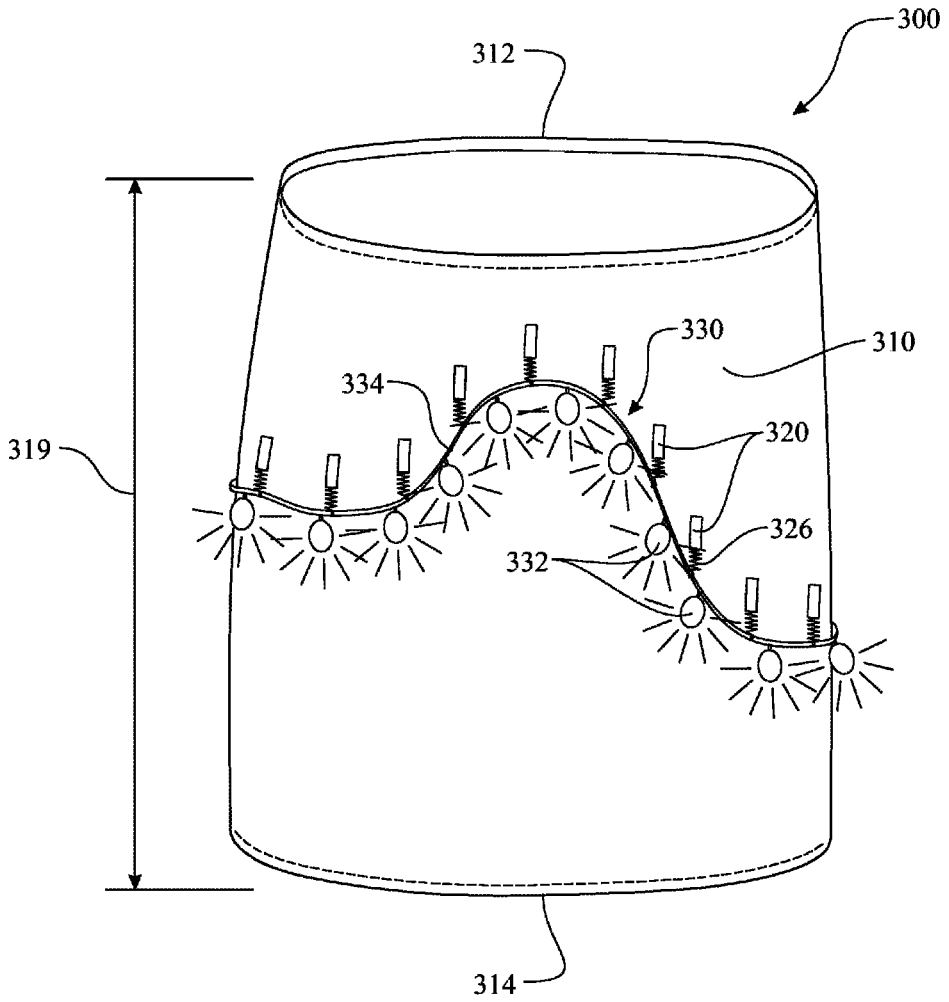
FIG. 6 presents a perspective view of an alterative exemplary embodiment of the illuminating undergarment, wherein the alterative illuminating undergarment temporarily assembles the plurality of illuminating devices to an outer surface of the undergarment material using a plurality of illuminating element retention assemblies or fasteners.

The first exemplary embodiment utilizes a series of illuminating device receiving pockets 120 for retaining the plurality of illuminating device assemblies 130. A second exemplary embodiment, referred to as an illuminating undergarment 300 and illustrated in FIG. 6, utilizes a plurality of illuminating element retention assemblies 320 for temporarily attaching one or more illuminating element assemblies 330 to an outer surface of an undergarment material 310. The illuminating undergarment 300 is fabricated in a manner similar to the illuminating undergarment 100, wherein like features of the illuminating undergarment 300 and the illuminating undergarment 100 are numbered the same except preceded by the numeral '3'. Each illuminating element retention assembly 320 includes an illuminating element retention element 326, wherein the illuminating element retention element 326 removeably secures the illuminating element assembly 330 to the undergarment material 310. The illuminating element retention element 326 can be provided as any suitable attachment element, including a spring, a flexible wire, a snap, a ribbon, and the like. In the second exemplary embodiment, the illuminating element assembly 330 is provided in a form factor having a series of illuminating elements 332 spatially arranged along a length of an illuminating element assembly electrical conductor 334. The illuminating element assembly electrical conductor 334 provides two functions to for the illuminating element assembly 330, the first being support of the illuminating elements 332 and the second being an electrical conduit between a portable power supply and each illuminating element 332. It is understood that illuminating element assembly 330 can be fabricated of any suitable multi-illuminating device configuration. This can include light emitting diode (LED) strips, ribbon lighting, and the like.

An undergarment length 319 can be defined as a distance between an undergarment waistband 312 and an undergarment hem 314. It is noted that the undergarment length 319 of the illuminating undergarment 300 is shorter than the undergarment length 119 of the illuminating undergarment 100. This illustrates the varied applications based upon differing desired lengths of the illuminating undergarment 100, 300.

Although the exemplary embodiments present different features, it is understood that features of each embodiment presented herein can be utilized with another embodiment. The illuminating undergarment 100, 300 can be manufactured having any of a variety of shapes and/or lengths. Additionally, the illuminating undergarment 100, 300 can include elements enabling the user to adjust the length accordingly. Although the illuminating device receiving pockets 120 and the illuminating element retention assemblies 320 present two embodiments for removably securing an illuminating device assembly 130, 330 to the illuminating undergarment 100, 300, it is understood that any suitable temporary retention device can be employed.

Although the exemplary embodiments of the illuminating undergarment 100, 300 are directed towards use under a skirt, it is understood that the same concept can be applied to a camisole, tank top, bra, undershirt, and the like for use in locations other than under a skirt portion of the outer garment.

Figure 7:
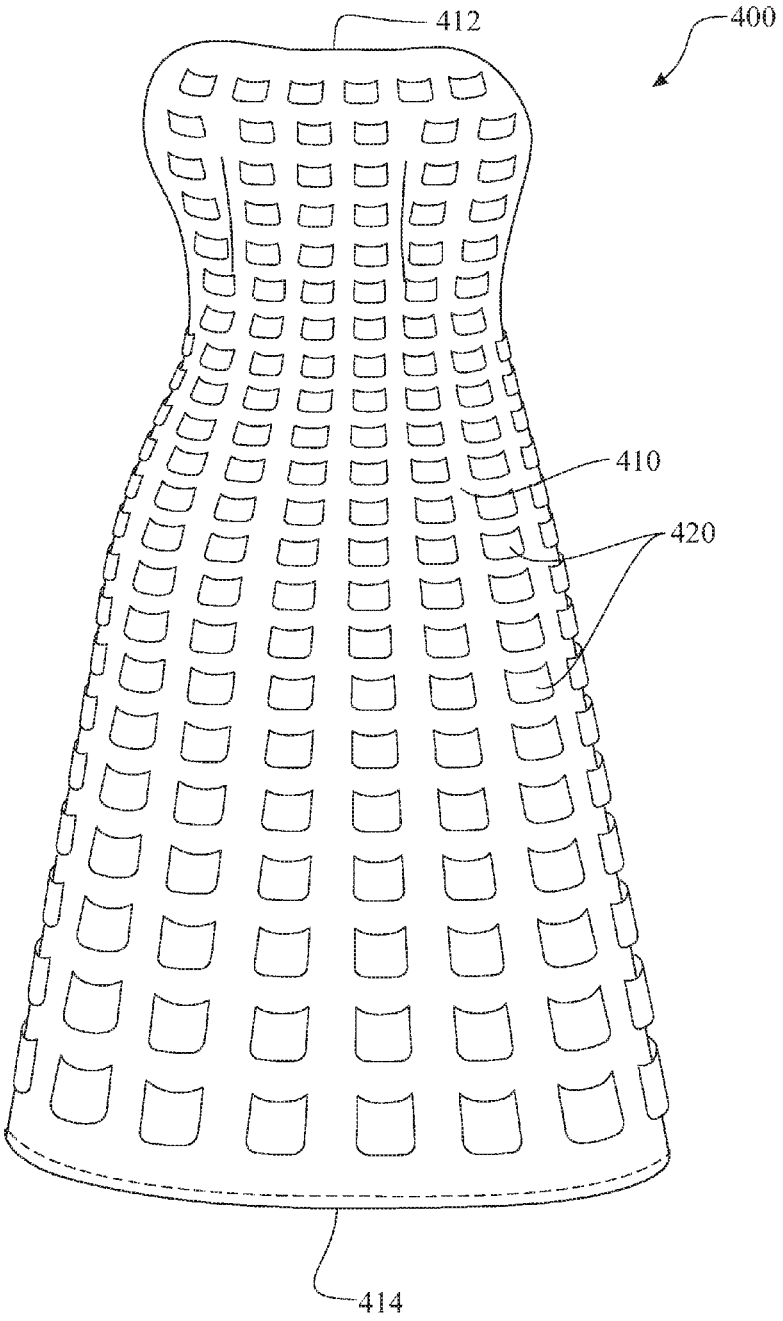
FIG. 7 presents a perspective view of another exemplary illuminating undergarment, wherein the illustrated embodiment is designed for use under a strapless dress.

As described above, the concept of the first exemplary embodiment of the undergarment 100 is designed for use as an underskirt. The concept of the undergarment 100 can be adapted for use under a dress 200 as shown in the exemplary embodiment presented in FIG. 7. The illuminating undergarment 400 is fabricated in a manner similar to the illuminating undergarment 100, wherein like features of the illuminating undergarment 400 and the illuminating undergarment 100 are numbered the same except preceded by the numeral '4'. For use as a dress illuminating undergarment 400, the upper opening 412 would define either a neckline or a bust line (as shown), the at least one lower opening 414 would define a hemline, and the undergarment body 410 would be shaped forming the dress undergarment 400.

Figure 8:
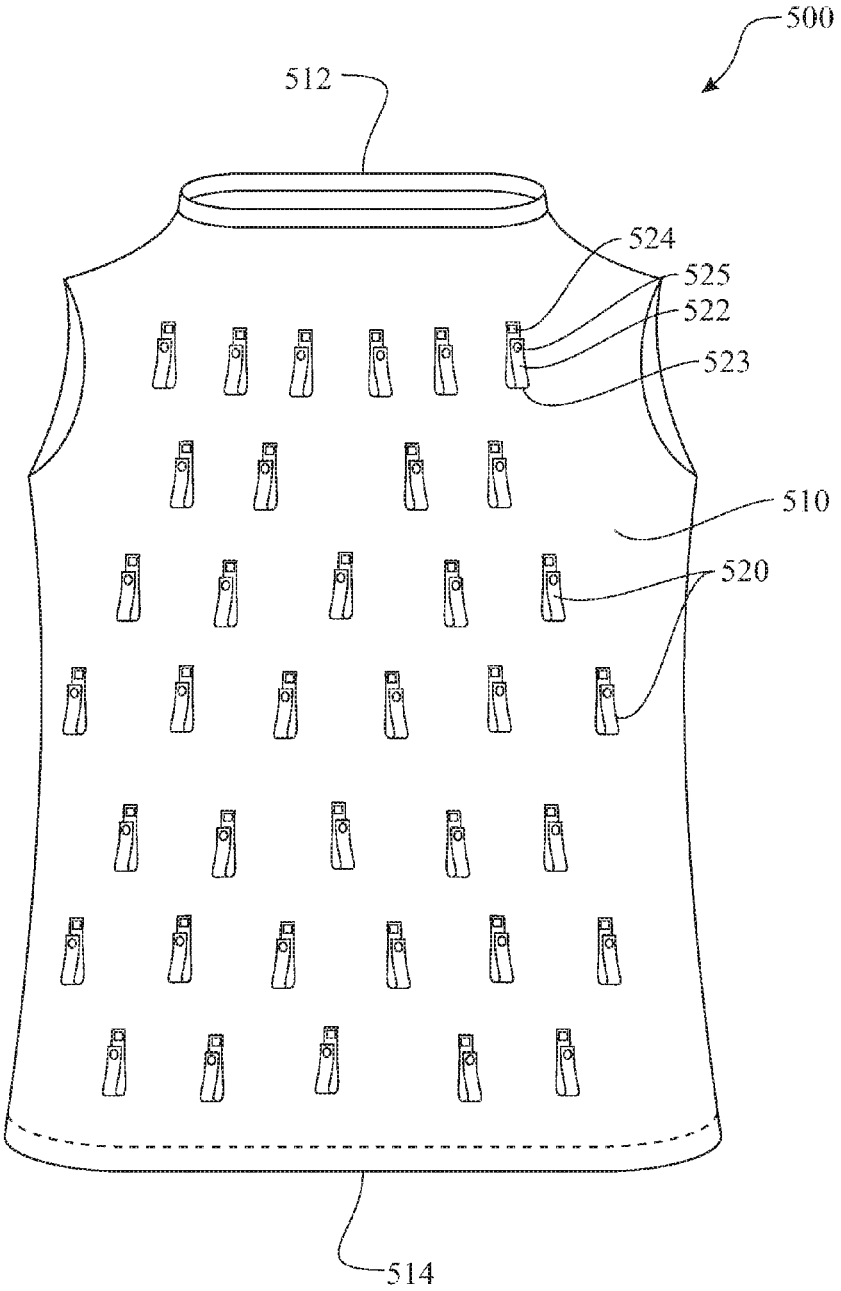
FIG. 8 presents a perspective view of yet another exemplary illuminating undergarment, wherein the illustrated embodiment is designed for use under a blouse.

Similarly, the concept of the undergarment 100 can be adapted for use under a top, such as a blouse, a camisole, a tank top, and the like as shown in the exemplary embodiment presented in FIG. 8. The illuminating undergarment 500 is fabricated in a manner similar to the illuminating undergarment 100, wherein like features of the illuminating undergarment 500 and the illuminating undergarment 100 are numbered the same except preceded by the numeral '5'. For use as a blouse undergarment 500, the upper opening 512 would define either a neckline (as shown) or a bust line, the at least one lower opening 514 would define a blouse hemline, and the undergarment body 510 would be shaped forming the blouse undergarment 500. The exemplary illuminating element retention assemblies 520 are formed comprising a strip of material 522 forming a loop 523 and a fastener 525. One end of the strip of material 522 is assembled to the undergarment material 510 by stitching 524 or any other suitable attachment method. A free portion of the fastener 525 is assembled to the opposite end of the strip of material 522, wherein when the free portion of the fastener 525 is temporarily engaging with a fixed portion of the fastener 525, the strip of material 522 forms the loop 523 for retaining the illuminating device assembly (not shown). The blouse illuminating undergarment 500 would preferably be fabricated of a stretch material, such as LYCRA™ to maintain a form fit upon the wearer 299.

Although the blouse undergarment 500 is illustrated having a shape of a sleeveless top, it is understood that the concept can be applied to any upper garment undergarment. This can include a tube top, wherein the undergarment waistband 512 would be located slightly above a bust line and the undergarment hem 514 would be located slightly below the bust line. In a second variant, the blouse undergarment 500 can be a bra. The undergarment 500 can be shaped in accordance with any known bra shape. The bra variant can be an actual bra or a garment adapted to be worn over a bra.

Figure 9:
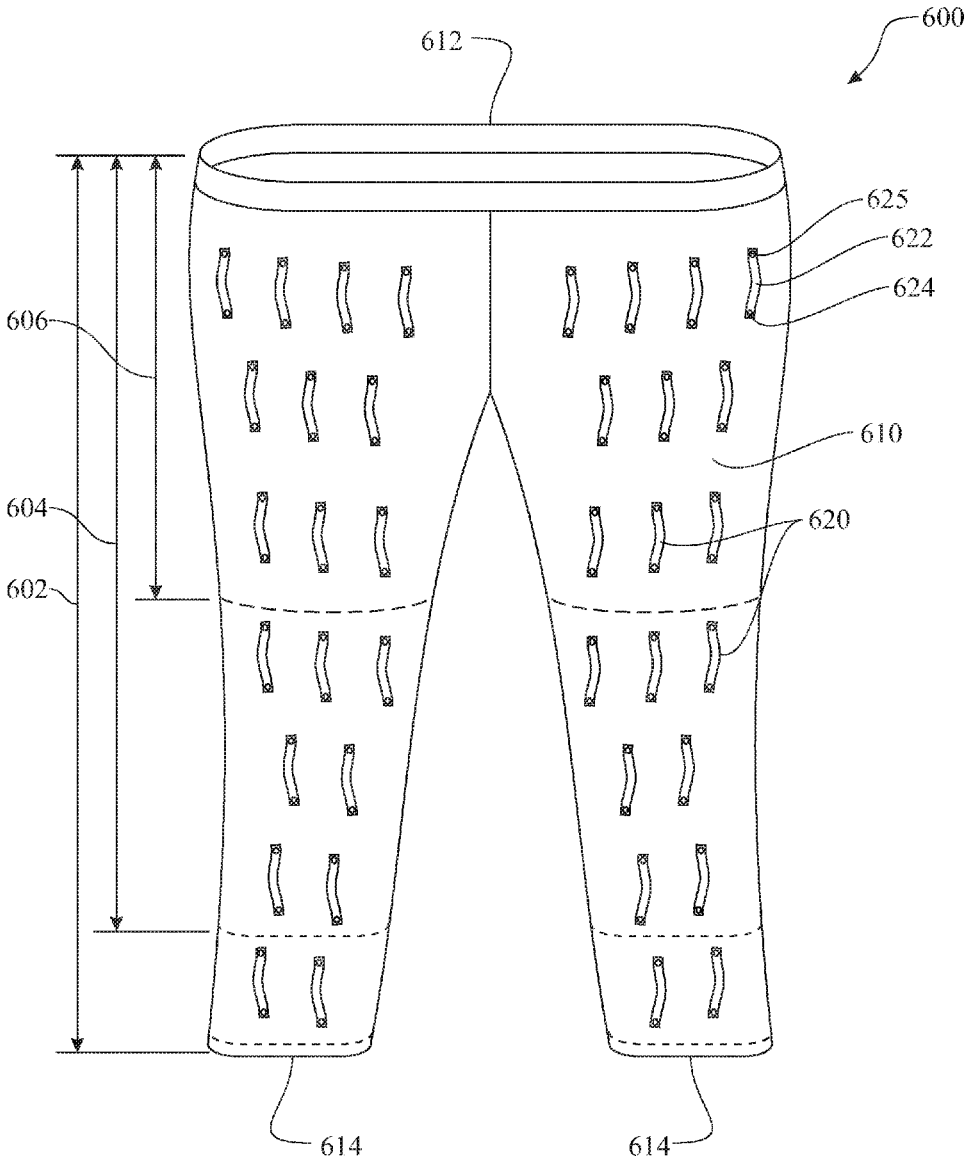
FIG. 9 presents a perspective view of yet another exemplary illuminating undergarment, wherein the illustrated embodiment is designed for use under one of pants, culottes, or shorts.

In yet another adaptation, the concept of the undergarment 100 can be adapted for use under pants (referenced by a pant length 602), culottes (referenced by a culottes length 604), and/or shorts (referenced by a shorts length 606), and the like, as shown in the exemplary embodiment presented in FIG. 9. The illuminating undergarment 600 is fabricated in a manner similar to the illuminating undergarment 100, wherein like features of the illuminating undergarment 600 and the illuminating undergarment 100 are numbered the same except preceded by the numeral '6'. For use as a pants undergarment 600, the upper opening 612 would define a waistline, the at least one lower opening 614 would be provided as a pair of lower openings 614, defining a pant hemline, and the undergarment body 610 would be shaped forming the pants undergarment 600. The exemplary illuminating element retention assemblies 620 are formed comprising a strip of material 622. One end of the strip of material 622 is assembled to the undergarment material 610 by stitching 624 or any other suitable attachment method. A fastener 625 is provided at a free end of the strip of material 622. The fastener 625 is temporarily secured to a fastener counterpart that is assembled to the undergarment material 610. The illuminating device assembly (not shown) is retained by a free section of the strip of material 622 extending between the fixed end and the fastener end. The pants illuminating undergarment 600 would preferably be fabricated of a stretch material, such as LYCRA™ to maintain a form fit upon the wearer 299.

The pants illuminating undergarment 600 can be of any suitable length, as illustrated in FIG. 9. A first exemplary length is a pant length 602, having length locating the undergarment hem 614 near the floor. Other various exemplary lengths are indicated by broken lines. A second exemplary length is a culottes length 604, having length locating the undergarment hem 614 approximately level with an ankle or slightly higher thereof. A third exemplary length is a shorts length 606, having length locating the undergarment hem 614 at any suitable shorts length, including a board short length, a knee length, a mid thigh length, or a length for short shorts, locating the undergarment hem 614 proximate an upper thigh or higher.

Although the pants illuminating undergarment 600 is illustrated having a shape of pants or leggings, it is understood that the concept can be applied to any lower garment undergarment. This can include a panty, wherein the undergarment waistband 612 would be located slightly about or proximate a wearer's waistline and the undergarment hemlines 614 would be located about or proximate a wearer's hip. The undergarment 600 can be shaped in accordance with any known panty shape. The panty variant can be an actual panty or a garment adapted to be worn over a panty.

Figure 10:
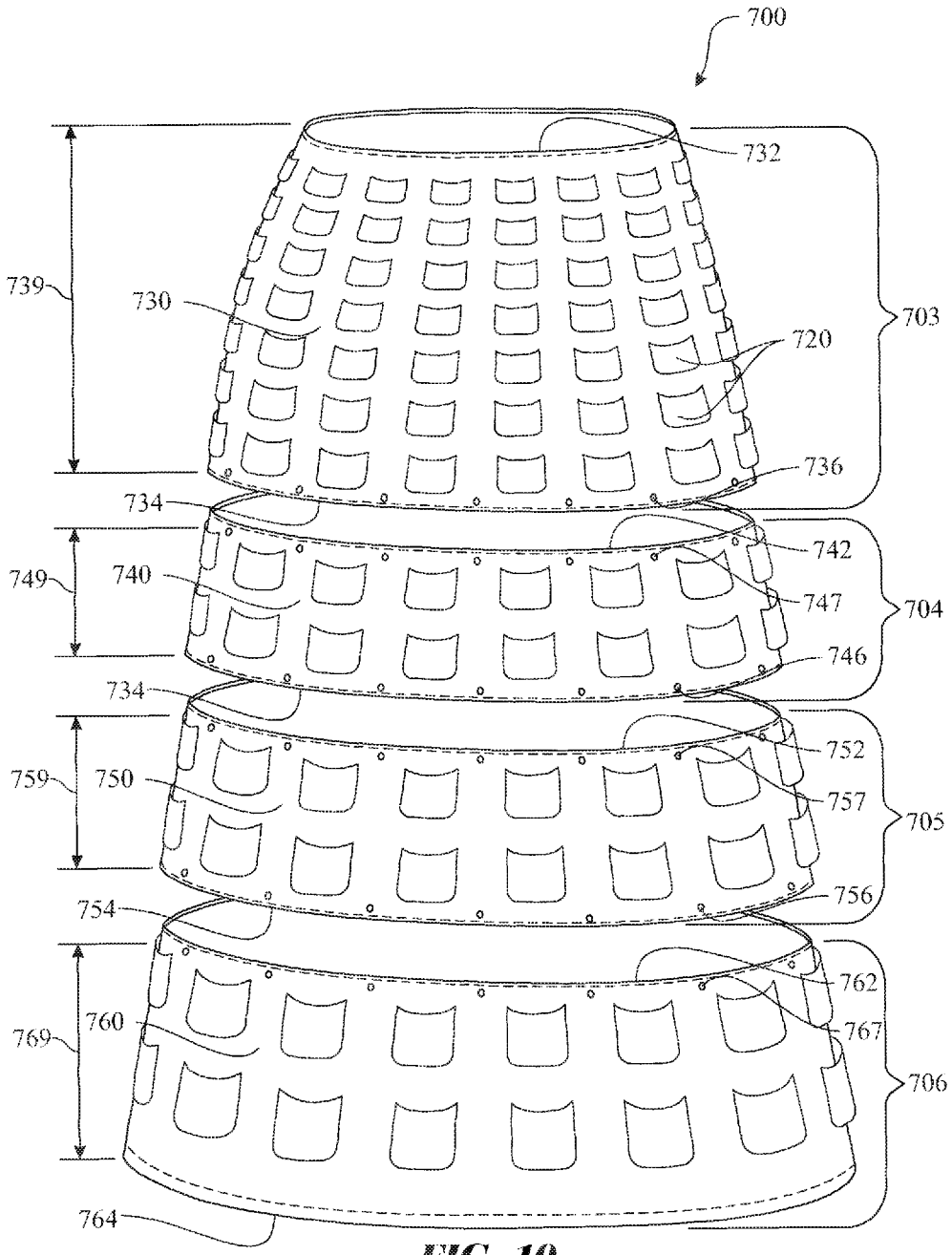
FIG. 10 presents a perspective view of an exemplary enhancement to the illuminating undergarment, wherein the enhancement segments the undergarment for sizing, introduction of additional features, and/or interchangeable features.

The illuminating undergarment can be tailored as a single garment, or segmented, as introduced by an adjustable length skirt illuminating undergarment 700 in FIG. 10. The exemplary adjustable length skirt illuminating undergarment 700 includes four segments, including an adjustable skirt undergarment upper segment 703, an adjustable skirt undergarment first central segment 704, an adjustable skirt undergarment second central segment 705, and a 706. Although the exemplary adjustable length skirt illuminating undergarment 700 includes four segments, it is understood that the adjustable length skirt illuminating undergarment 700 can include two or more segments. The exemplary adjustable length skirt illuminating undergarment 700 introduces the adjustable skirt undergarment upper segment 703 and the adjustable skirt undergarment lower segment 706, which would be the minimum number of segments, comprising respective features. The exemplary adjustable length skirt illuminating undergarment 700 additionally introduces an adjustable skirt undergarment first central segment 704 and an adjustable skirt undergarment second central segment 705, which are intermediary segments provided for assembly between two adjacent segments.

Each segment 703, 704, 705, 706 is tailored forming a respective adjustable skirt undergarment segment body 730, 740, 750, 760. The adjustable skirt undergarment upper segment 703 can be considered a primary or base undergarment, having an adjustable skirt undergarment upper segment waistline 732 adapted for placement about a wearer's waist. The adjustable skirt undergarment upper segment 703 is sized having an adjustable skirt undergarment upper segment length 739, wherein the adjustable skirt undergarment upper segment length 739 is measured between the adjustable skirt undergarment upper segment waistline 732 to the adjustable skirt undergarment upper segment lower edge 734. A series of illuminating element retention assemblies 720 are spatially arranged about the respective adjustable skirt undergarment segment body 730. An attachment feature, such as a series of adjustable skirt undergarment upper segment lower edge extension features 736, is provided about the adjustable skirt undergarment upper segment material 730 at a location proximate the adjustable skirt undergarment upper segment lower edge 734 of the adjustable skirt undergarment upper segment 703.

The adjustable skirt undergarment upper segment 703 and the adjustable skirt undergarment lower segment 706 are similar in nature, and comprise a number of like elements. Like elements of the adjustable skirt undergarment upper segment 703 and the adjustable skirt undergarment lower segment 706 are numbered the same except preceded by the numeral '76'. An attachment feature, such as a series of adjustable skirt undergarment lower segment upper edge extension features 767, is provided about the adjustable skirt undergarment lower segment material 760 at a location proximate the adjustable skirt undergarment lower segment upper edge 762 of the adjustable skirt undergarment lower segment 706. The adjustable skirt undergarment lower segment upper edge extension feature 767 would be selected to enable joining the adjustable skirt undergarment lower segment 706 to the adjustable skirt undergarment upper segment 703 using the adjustable skirt undergarment lower segment upper edge extension feature 767 and the adjustable skirt undergarment upper segment lower edge extension feature 736. The assembly mechanism for joining the adjustable skirt undergarment lower segment 706 to the adjustable skirt undergarment upper segment 703 can include any of the following: a cording, a ribbon, a series of eyelets, a series of buttons and buttonholes, a series of snaps, a series of hooks and loops, a dense hook and loop tape, a series of segments of a dense hook and loop tape, a series of magnets and magnetically attracted material, a zipper, an adhesive, and the like, and any combination thereof.

In a preferred configuration, the adjustable skirt undergarment lower segment hem line 764 is preferably aesthetically pleasing, or more specifically, exclusive of any attachment features. Alternatively, the respective adjustable skirt undergarment segment lower edge extension feature 736, 746, 756, would be assembled to the respective adjustable skirt undergarment segment material 730, 740, 750 in a manner where the respective adjustable skirt undergarment segment lower edge extension feature 736, 746, 756 is concealed from view. This can be accomplished using any suitable concealed extension feature (such as a dense hook and loop tape, hook and eyes, and the like); assembling the extension feature to a lining material of the garment segment 703, 704, 705 and/or assembling the extension feature to an interior flange formed within the garment segment 703, 704, 705.

Each respective adjustable skirt undergarment segment upper edge 742, 752, 762 is preferably adapted to be assembled to an interior surface of the adjacent adjustable skirt undergarment segment lower edge 734, 744, 754. More specifically, the lower edge extension feature 736, 746, 756 of the upper adjustable skirt undergarment segment 703, 704, 705 and upper edge extension feature 747 of the lower adjustable skirt undergarment segment 704, 705, 706 are mechanically coupled to one another, joining adjacent segments to one another.

This configuration conceals the method of joining the two adjacent undergarment segments. It is understood that the assembly and configurations could be reversed.

Each of the garment segments 703, 704, 705, 706 is tailored having a length 739, 749, 759, 769, respectively. The length 739, 749, 759, 769 of each garment segment 703, 704, 705, 706 can be the same as the others, differ from each of the others, of be of any other combination of lengths. This enables the user to selectively combine the garment segments 703, 704, 705, 706 to create an adjustable length skirt illuminating undergarment 700 having a preferred finished overall length. The intermediary garment segments 704, 705.

A circumferential length of each respective adjustable skirt undergarment segment upper edge 742, 752, 762 can be adjustable to mate with any of the adjacent adjustable skirt undergarment segment lower edges 734, 744, 754. This would enable assembly of any of the adjustable skirt undergarment segments 704, 705, 706 to any of the adjustable skirt undergarment segments 703, 704, 705, thus increasing options for different overall lengths of the adjustable length skirt illuminating undergarment 700.

It is also understood that a feature can be incorporated into one or more of the garment segments 703, 704, 705, 706 to adjust the length 739, 749, 759, 769. This can include a vertically or longitudinally arranged belt, cording, series of snaps, and the like.

Although the illuminating element retention assemblies 720 are illustrated in a form factor of a pocket, it is understood that the illuminating element retention assemblies 720 can be of any suitable design and/or components for retaining the illuminating device assemblies 130.

Figure 11:
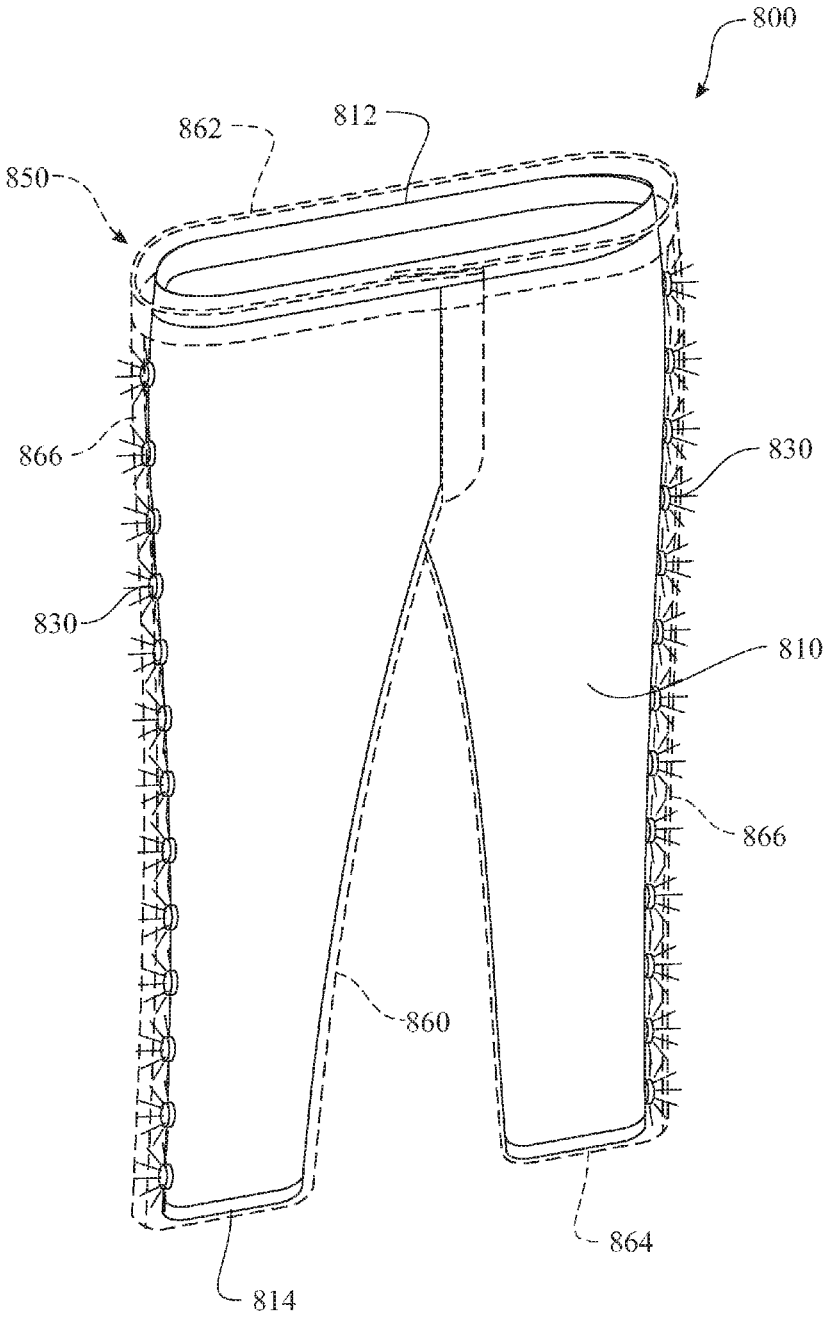
FIG. 11 presents a perspective view of yet another exemplary illuminating undergarment, wherein the illustrated embodiment is specifically adapted for use under tuxedo pants.

The illuminating undergarment can be adapted for use with more specific outer garments. In one example, a tuxedo pant illuminating undergarment 800 is adapted for use under tuxedo pants 850, as illustrated in FIG. 11. The tuxedo pants 850 is tailored of a tuxedo pants material 860, having a tuxedo pants waistline 862 formed about an upper end of the tuxedo pants 850 and a tuxedo pants hemline 864 formed about each lower end of each pant leg of the tuxedo pants 850. The tuxedo pants 850 includes a tuxedo pants light permissive leg stripe 866 extending along an outer seam of each pant leg between the tuxedo pants waistline 862 and the tuxedo pants hemline 864 as illustrated. The tuxedo pants light permissive leg stripe 866 can be fabricated of a translucent material, a transparent material, or any other suitable light-permissive material.

The tuxedo pant illuminating undergarment 800 is similar to the pants illuminating undergarment 600 illustrated in FIG. 9. Like features of the tuxedo pant illuminating undergarment 800 and the pants illuminating undergarment 600 are numbered the same except preceded by the numeral '8'. The tuxedo pant illuminating undergarment 800 is distinguished from the pants illuminating undergarment 600 by the location of the illuminating device assemblies 830. This can be accomplished by limited a location of the illuminating element retention assemblies (not shown for clarity) or the placement of the illuminating device assemblies 830, as shown. In the exemplary application, the illuminating device assemblies 830 would be located in registration with the respective tuxedo pants light permissive leg stripe 866.

Although the exemplary application is directed towards illuminating the tuxedo pants light permissive leg stripe 866 of the tuxedo pants 850, it is understood that the undergarment can be adapted to illuminate any specific feature of a respective outer garment. For example, the illuminated elements can be arranged to emit a light behind artwork provided on any outer garment, including a shirt, dress, skirt, pants, and the like.

Figure 12:
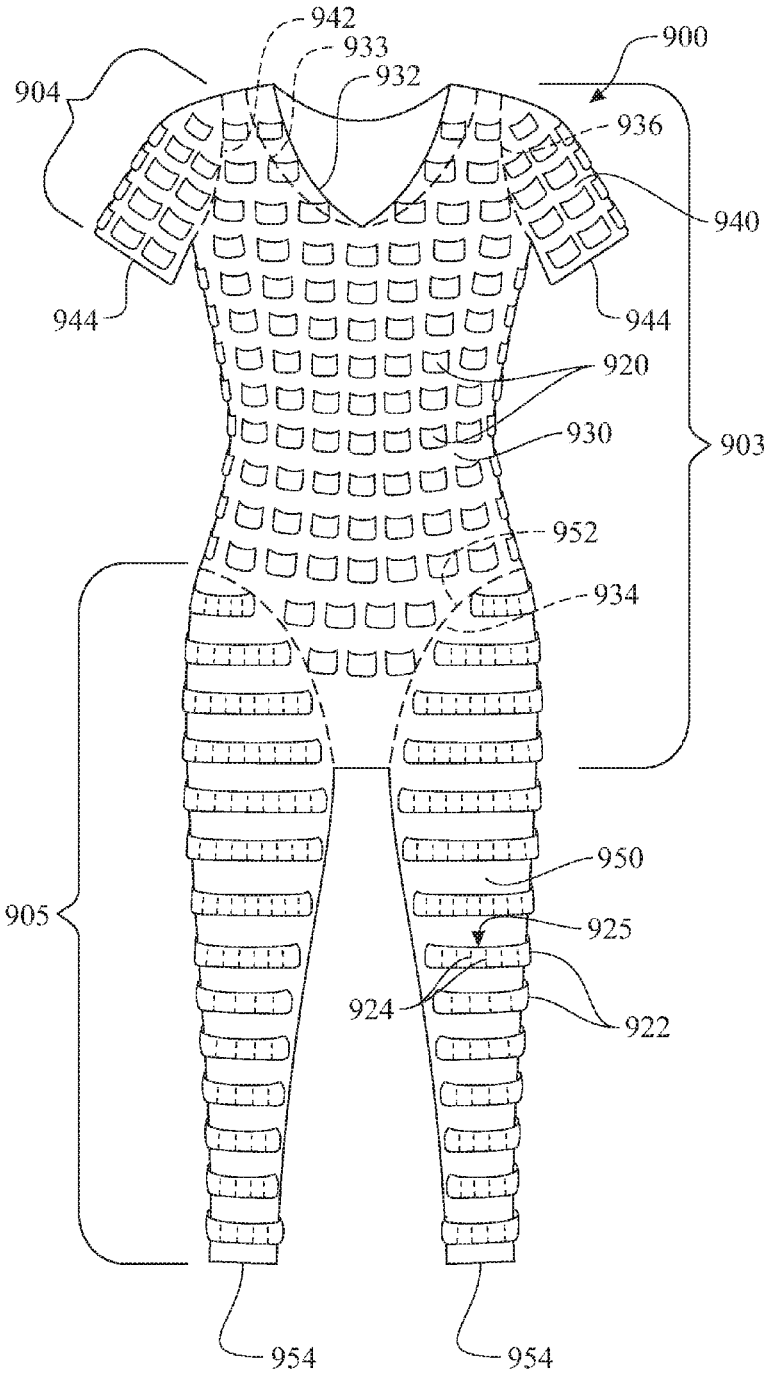
FIG. 12 presents a perspective view of yet another exemplary illuminating undergarment, wherein the illustration presents a variety of form factors of a body suit.

An exemplary illuminating bodysuit shaped undergarment 900 is presented in FIG. 12. The exemplary illuminating bodysuit shaped undergarment 900 introduces several additional enhancements over the previously described variants. The illuminating bodysuit shaped undergarment 900 includes an illuminating leotard shaped undergarment 903, wherein the illuminating leotard shaped undergarment 903 is a primary segment of the illuminating bodysuit shaped undergarment 900. The illuminating leotard shaped undergarment 903 is fabricated of an illuminating leotard shaped undergarment material 930. The illuminating leotard shaped undergarment 903 is designed to cover a torso of the wearer. The illuminating leotard shaped undergarment 903 includes an illuminating unitard shaped undergarment first neckline 932 sized and shaped to enable passage of a wearer's head therethrough. The illuminating unitard shaped undergarment first neckline 932 can be of any suitable shape and size, such as an illuminating unitard shaped undergarment second neckline 933, a rounded or scalloped neckline, a square neckline, a more prominent "V" shaped neckline, and the like. The illuminating unitard shaped undergarment first neckline 932 can alternatively be provided in a strapless form factor.

The illuminating leotard shaped undergarment 903 can include or exclude a pair of illuminating leotard shaped undergarment sleeves 904. The illuminating leotard shaped undergarment sleeves 904 is fabricated of an illuminating leotard shaped undergarment sleeve material 940, extending between an illuminating unitard shaped undergarment sleeve shoulder hemline 942 and an illuminating unitard shaped undergarment sleeve cuff 944. The illuminating unitard shaped undergarment sleeve cuff 944 can be located to provide any suitable sleeve length, including cap sleeves, short sleeves, three-quarter length sleeves, or wrist length sleeves. When configured having detachable illuminating leotard shaped undergarment sleeves 904, the user can change the illuminating leotard shaped undergarment sleeves 904 to change the length, the color, the material, the configuration of the illuminating element retention assemblies 920, and the like.

When included, the illuminating leotard shaped undergarment sleeves 904 can be integral with the illuminating leotard shaped undergarment 903 or detachable from the illuminating leotard shaped undergarment 903, wherein the attachment mechanism would be any of the attachment mechanisms employed by the adjustable length skirt illuminating undergarment 700 described above.

A plurality of illuminating element retention assemblies 920 can be arranged to sparsely, partially, or largely cover each illuminating leotard shaped undergarment sleeve 904. When exclusive of the illuminating leotard shaped undergarment sleeves 904, the illuminating leotard shaped undergarment 903 would be finished along an illuminating unitard shaped undergarment tank top sleeve hemline 936. When inclusive of the illuminating leotard shaped undergarment sleeves 904, each illuminating leotard shaped undergarment sleeve 904 would extend to an illuminating unitard shaped undergarment sleeve cuff 944. A length of each illuminating leotard shaped undergarment sleeve 904 can vary. For example, the length of each illuminating leotard shaped undergarment sleeve 904 can provide any of the following:

a) a cap sleeve,
b) a short sleeve,
c) a three-quarter length sleeve, or
d) a long sleeve.

Similarly, the illuminating leotard shaped undergarment 903 can include or exclude a pair of illuminating leotard shaped undergarment leggings 905. Each of the illuminating leotard shaped undergarment leggings 905 is fabricated of an illuminating leotard shaped undergarment legging material 950. Each of the illuminating leotard shaped undergarment leggings 905 extends between an illuminating unitard shaped undergarment legging hip hemline 952 and an illuminating unitard shaped undergarment legging hemline 954. The illuminating unitard shaped undergarment legging hemline 954 can be located to provide any suitable legging length, including short shorts, knee length, long board or upper calf length, culottes length, of full pant length.

When included, the illuminating leotard shaped undergarment leggings 905 can be integral with the illuminating leotard shaped undergarment 903 or detachable from the illuminating leotard shaped undergarment 903, wherein the attachment mechanism would be any of the attachment mechanisms employed by the adjustable length skirt illuminating undergarment 700 described above. The illuminating unitard shaped undergarment legging hip hemline 952 and the illuminating unitard shaped undergarment hip hemline 934 would include attachment mechanisms for joining each illuminating leotard shaped undergarment legging 905 and the illuminating leotard shaped undergarment 903 to one another.

Each illuminating leotard shaped undergarment legging 905 introduces an illuminating element retention multi-section pocket assembly 922 for retaining the illuminating device assembly 130. The illuminating element retention multi-section pocket assembly 922 is a variant of the illuminating element retention assembly 920. The illuminating element retention multi-section pocket assembly 922 is segmented into a plurality of illuminating element retention segmented pockets 925 by illuminating element retention segmenting pocket stitching 924. A plurality of illuminating element retention multi-section pocket assemblies 922 can be arranged to sparsely, partially, or largely cover each illuminating leotard shaped undergarment legging 905. When exclusive of the illuminating leotard shaped undergarment leggings 905, the illuminating leotard shaped undergarment 903 would be finished along an illuminating unitard shaped undergarment hip hemline 934. When inclusive of the illuminating leotard shaped undergarment leggings 905, each illuminating leotard shaped undergarment legging 905 would extend to an illuminating unitard shaped undergarment legging hemline 954. A length of each illuminating leotard shaped undergarment legging 905 can vary. For example, the length of the illuminating leotard shaped undergarment legging 905 can provide any of the following:

a) full length pants,
b) ankle length pants,
c) culottes,
d) shorts,
e) short shorts,
f) capri or calf length pants, or
g) board or knee length shorts.

The illuminating leotard shaped undergarment 903, each illuminating leotard shaped undergarment sleeve 904, and each illuminating leotard shaped undergarment legging 905 can be fabricated of a body contouring or stretchable material, wherein the stretchable material is at least one of a knit material; an elastic latex based material; an elastic latex-free material; such as SPANDEX™, LYCRA™; ELASTANE™, and the like.

Figure 13:
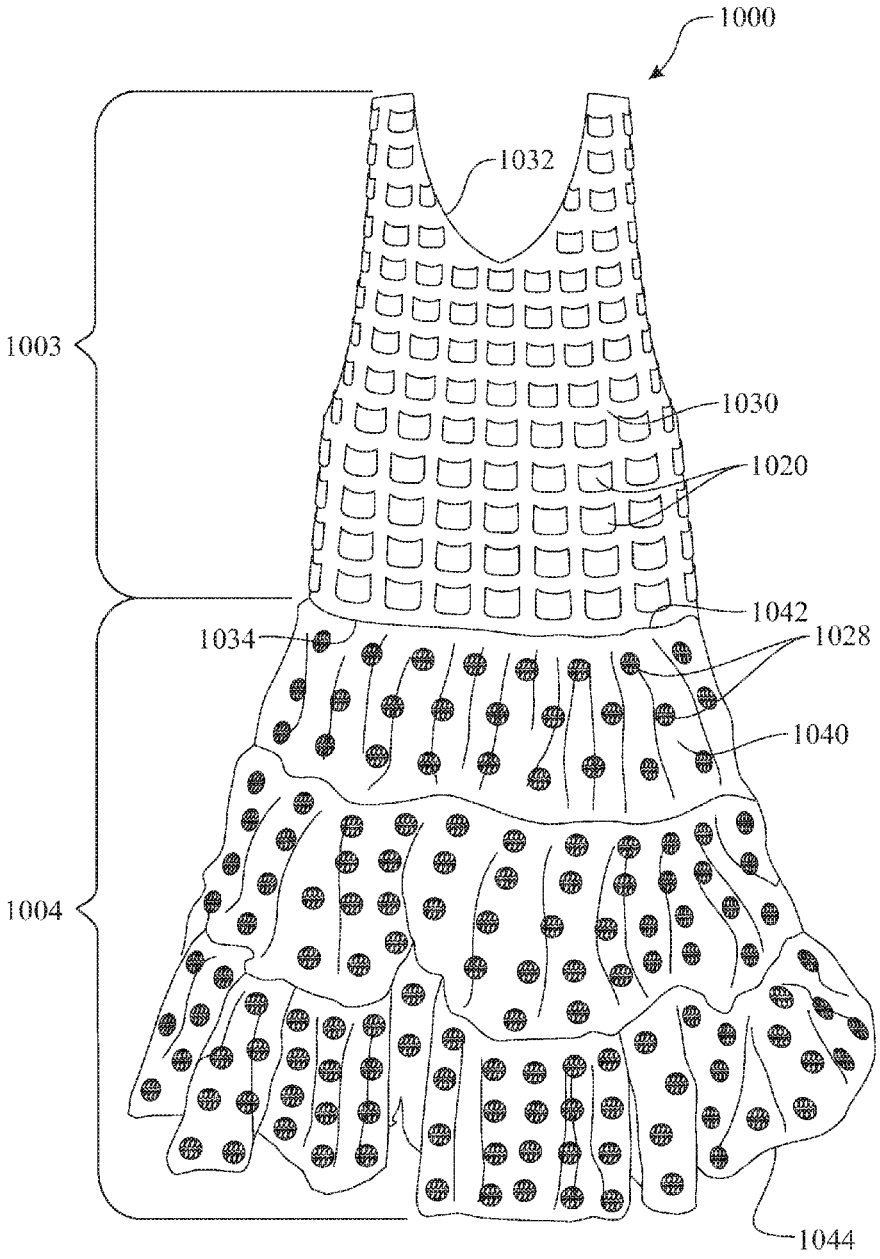
FIG. 13 presents a perspective view of yet another exemplary illuminating undergarment, wherein the illustration presents a casual dress.

The illuminating undergarment can be of any suitable shape and size. An illuminating dress undergarment 1000, introduced in FIG. 13, is yet another exemplary variant of the undergarment. The exemplary illuminating dress undergarment 1000 includes an illuminating blouse shaped undergarment 1003 and an illuminating petticoat 1004. The illuminating blouse shaped undergarment 1003 is tailored having an illuminating blouse segment undergarment material 1030 extending between an illuminating blouse segment undergarment neckline 1032 and an illuminating blouse segment undergarment hip hemline 1034. The illuminating blouse segment undergarment material 1030 can be a woven material, a knit material, an elastic based material, and the like. A plurality of illuminating element retention assemblies 1020 can be arranged to sparsely, partially, or largely cover the illuminating blouse shaped undergarment 1003.

The illuminating petticoat 1004 is tailored having an illuminating petticoat material 1040 extending between an illuminating petticoat waistline 1042 and an illuminating petticoat hemline 1044. The illuminating petticoat material 1040 can be a woven material, a netting material, a lace, and the like. The illuminating petticoat 1004 is designed to provide fullness to the outer garment. The illuminating petticoat 1004 is commonly tailored by gathering an edge of the material to create a fuller body.

The combination of the lightweight material and the gathering process introduces a need for yet another variant of the illuminating element retention assembly. In the exemplary variant, the illuminating element retention assembly is a dense hoop and loop tape based illuminating element retention assembly 1028. In a preferred configuration, the dense loop section of the dense hoop and loop tape based illuminating element retention assembly 1028 would be attached to the material of the illuminating undergarment and the dense hook section of the dense hoop and loop tape based illuminating element retention assembly 1028 would be attached to the illuminating device assembly 130. The dense loop section of the dense hoop and loop tape based illuminating element retention assembly 1028 will not damage the material of the illuminating undergarment during cleaning, whereas the dense hook section of the dense hoop and loop tape based illuminating element retention assembly 1028 might.

In one configuration, the illuminating blouse shaped undergarment 1003 and the illuminating petticoat 1004 can be integral with one another, joining the illuminating blouse segment undergarment hip hemline 1034 and the illuminating petticoat waistline 1042 with one another using stitching, a continuous sheet of material, and the like. In another configuration, the illuminating blouse segment undergarment hip hemline 1034 and the illuminating petticoat waistline 1042 can be detachably assembled to one another using any of the attachment mechanisms employed by the adjustable length skirt illuminating undergarment 700 described above.

In one variant, the illuminating petticoat 1004 can be of a netting or other material, wherein, when gathered, extends outward. In a preferred arrangement, the material 1040 would extend generally radially outward from the waistline 1042. In this arrangement, the illuminating petticoat 1004 can be used underneath of a tutu. In this variant, the illuminating dress undergarment 1000 can be inclusive of the illuminating blouse shaped undergarment 1003 or exclusive of the illuminating blouse shaped undergarment 1003.

Any of the variants of the illuminating undergarment can include any suitable length sleeve, any suitable shaped neckline, any suitable shaped bottom (pant legs or skirt), and the like. The various features can be tailored as a single garment or in attachable/detachable segments, as employed by the adjustable length skirt illuminating undergarment 700. Each of the variants can include any suitable illuminating element retention assembly form factor.

Since many modifications, variations, and changes in detail can be made to the described preferred embodiments of the invention, it is intended that all matters in the foregoing description and shown in the accompanying drawings be interpreted as illustrative and not in a limiting sense.

Although the preferred embodiment locates the illuminating device receiving features 120 on an exterior surface of the illuminating undergarment 100, it is understood that the illuminating device receiving features 120 can be located on an interior surface of the illuminating undergarment 100 when the illuminating undergarment 100 is fabricated of a sheer, translucent, or transparent material.

It is understood that the illuminated light can be transferred from the light source to a desired illuminating location using one or more fiber optic strands.

In yet another embodiment, it is understood that the illumination source can be provided by a Chemiluminescence process. Each illuminating element would include compartments comprising chemicals, wherein when the chemicals are mixed together, the illuminating element emits light.

One noted benefit is the ability to wash the undergarment 100, as the electrical components are removeable. Another benefit would be freedom to introduce lighting to any garment tailored of a suitable material. This provides a merchant with a wider offering while stocking a small inventory of illuminating undergarments 100. The merchant can offer an illuminating undergarment 100 for use under any other suitable outer garment 200 to create a new illuminating effect. The illuminating undergarments 100 can be provided having illuminating device receiving features 120 in any of a variety of patterns, thus exponentially increasing the options and combinations for the consumer. The consumer can additionally wear the illuminating undergarment 100 with other suitable outer garments 200, thus further increasing the flexibility for use. The end result is a multi-function device that provides an affordable and adapting solution for the consumer.

Thus, the scope of the invention should be determined by the appended claims and their legal equivalence.

REFERENCE ELEMENT DESCRIPTIONS

Ref No. Description

100 illuminating undergarment
110 undergarment material
112 undergarment waistband
114 undergarment hem
119 undergarment length
120 illuminating device receiving pockets
122 pocket material
124 pocket attachment stitching
126 pocket exterior
128 pocket interior
130 illuminating device assembly
132 illuminating device housing
134 illuminating element
136 illumination switch
138 portable power supply
139 illumination circuit
140 illuminated image
150 illuminated message
152 first illuminated message segment
154 second illuminated message segment
156 third illuminated message segment
200 outer garment
210 garment material
212 garment neckline
213 garment waistline

214 garment hemline
216 exposed or outer garment surface
218 concealed or inner garment surface
219 garment skirt length
220 bodice portion
222 midriff portion
224 skirt portion
299 wearer
300 illuminating undergarment
310 undergarment material
312 undergarment waistband
314 undergarment hem
319 undergarment length
320 illuminating element retention assembly
326 illuminating element retention element
330 illuminating element assembly
332 illuminating elements
334 illuminating element assembly electrical conductor
400 dress illuminating undergarment
410 undergarment material
412 undergarment waistband
414 undergarment hem
420 illuminating element retention assembly
500 blouse illuminating undergarment
510 undergarment material
512 undergarment waistband
514 undergarment hem
520 illuminating element retention assembly
522 strip of material
523 loop
524 stitching
525 fastener
600 pants illuminating undergarment
602 pant length
604 culottes length
606 shorts length
610 undergarment material
612 undergarment waistband
614 undergarment hem

What I claim is:

1. An illuminating undergarment adapted to be worn under a light permissive outer garment, the-illuminating undergarment comprising:

an undergarment body tailored of an undergarment material, said undergarment body extending between an upper opening and at least one lower opening, an orientation of said undergarment body defining an exterior surface and an interior surface;

a plurality of illuminating device attachment elements affixed to a central region of said undergarment body;

at least one illuminating assembly comprising at least one illuminating element, each said illuminating element of said at least one illuminating assembly is arranged to emit light in a direction outward from and generally perpendicular to a plane defined by the exterior surface of the undergarment body, each said illuminating element of said at least one illuminating assembly is removably attached to said undergarment body exterior surface by a respective illuminating device attachment element of said plurality of illuminating device attachment elements.

2. An illuminating garment combination as recited in claim 1, said undergarment body having a shape for one of:

a dress undergarment, wherein said upper opening defines one of a neckline or a bust line and said at least one lower opening defines a hemline, and said dress undergarment is adapted to be worn under said outer garment, wherein said outer garment is a dress, a blouse undergarment, wherein said upper opening defines one of a neckline or a bust line and said at least one lower opening defines a waist hem, and said blouse undergarment is adapted to be worn under said outer garment, wherein said outer garment is a blouse, a blouse undergarment, said blouse undergarment having a tube top shape, wherein said upper opening defines an upper bust line and said at least one lower opening defines a lower bust line hem, and said blouse undergarment is adapted to be worn under said outer garment, a blouse undergarment, said blouse undergarment having a bra shape, wherein said upper opening defines one of a neckline or a bust line and said at least one lower opening defines a lower bust line hem, and said blouse undergarment is adapted to be worn under said outer garment, a skirt undergarment, wherein said upper opening defines a waistline and said at least one lower opening defines a hemline, and said skirt undergarment is adapted to be worn under said outer garment, wherein said outer garment is a skirt, a tutu undergarment, wherein said upper opening defines a waistline and said at least one lower opening defines a hemline, said undergarment body tailored of said fabric arranged extending generally radially outwards from said waistline, and said skirt undergarment is adapted to be worn under said outer garment, wherein said outer garment is a tutu, a pants undergarment, wherein said upper opening defines a waistline and said at least one lower opening defines a pair of hemlines, and said pants undergarment is adapted to be worn under said outer garment, wherein said outer garment is pants, a culottes undergarment, wherein said upper opening defines a waistline and said at least one lower opening defines a pair of hemlines, and said culottes undergarment is adapted to be worn under said outer garment, wherein said outer garment is culottes, a shorts undergarment, wherein said upper opening defines a waistline and said at least one lower opening defines a pair of hemlines, and said shorts undergarment is adapted to be worn under said outer garment, wherein said outer garment is shorts, a panty shaped undergarment, wherein said upper opening defines a waistline and said at least one lower opening defines a pair of hip hemlines, and said panty shaped undergarment is adapted to be worn under said outer garment, a bodysuit shaped undergarment, said bodysuit shaped garment being fabricated of a stretchable material, wherein said upper opening defines one of a neckline or a bust line, and said at least one lower opening defines a pair of hemlines, said bodysuit shaped undergarment comprising a torso covering and at least one of sleeveless, having a sleeve of any length, legless, and having a legging of any length, and said bodysuit shaped undergarment is adapted to be worn under said outer garment or a unitard shaped undergarment, said unitard shaped garment being fabricated of a stretchable material, wherein said upper opening defines one of a neckline or a bust line, and said at least one lower opening defines a pair of hemlines, and said unitard shaped undergarment is adapted to be worn under said outer garment.

3. An illuminating garment combination as recited in claim 1, wherein said plurality of illuminating device attachment elements are spatially arranged about said undergarment material in at least one of:

an array pattern, a vertically aligned array pattern, a horizontally aligned array pattern, a diagonally aligned array pattern, a predetermined pattern representative of a phrase, a predetermined pattern representative of an image, and a random pattern.

4. An illuminating garment combination as recited in claim 1, said outer garment further comprising at least one light permissive feature, wherein said plurality of illuminating assemblies are spatially arranged about said undergarment material to illuminate said at least one outer garment light permissive feature.

5. An illuminating garment combination as recited in claim 1, said undergarment body comprising one primary undergarment body segment and at least one secondary undergarment body segment, wherein said one primary undergarment body segment and said at least one secondary undergarment body segment are adapted to be detachably joined to one another.

6. An illuminating garment combination as recited in claim 1, wherein at least one of said plurality of illuminating device attachment elements is at least one of:

a) a pocket assembled to said undergarment material, b) a strap for receiving and temporarily assembling at least one of said at least one illuminating assembly to said undergarment body, c) a loop for receiving and temporarily assembling at least one of said at least one illuminating assembly to said undergarment body, d) a magnet and a mating magnetically attracted material for temporarily assembling at least one of said at least one illuminating assembly to said undergarment body, and e) a dense hook and loop tape for temporarily assembling at least one of said at least one illuminating assembly to said undergarment body.

7. An illuminating garment combination as recited in claim 1, wherein said at least one illuminating element is one of a light emitting diode (LED), a fluorescent bulb, an electroluminescent element, an incandescent bulb, and a chemiluminescent material.

8. An illuminating garment combination as recited in claim 1, further comprising a portable power supply, said at least one illuminating element in electrical communication with said portable power supply.

9. An illuminating garment combination as recited in claim 1, further comprising a portable power supply, said at least one illuminating assembly further comprising an illuminating device housing, wherein said at least one illuminating element and said portable power supply are carried by said illuminating device housing.

10. An illuminating garment combination as recited in claim 1, said at least one illuminating assembly further comprising a portable power supply, an electrically conductive wire, and said at least one illuminating element further comprising a plurality of illuminating elements, wherein said electrically conductive wire carries each of said plurality of illuminating elements and provides electrical communication between each of said plurality of illuminating elements and said portable power supply.

11. An illuminating garment combination as recited in claim 1, said at least one illuminating assembly further comprising an illumination circuit, wherein said illumination circuit enables illumination of said at least one illuminating element in accordance with at least one of a group of operational modes, wherein said group of operational modes includes:

a continuous emission of light, a flashing emission of light, a sequential emission of light, a color changing emission of light.

12. An illuminating garment combination as recited in claim 1, said at least one illuminating assembly further comprising a thermal barrier, wherein said thermal barrier is located between at least one of said at least one illuminating element and an interior space defined by said interior surface of said undergarment body.

13. An illuminated garment combination, comprising:

an illuminating undergarment comprising:

an undergarment body having an undergarment material extending between an upper opening and at least one lower opening, an orientation of said undergarment body defining an exterior surface and an interior surface;

a plurality of illuminating device attachment elements affixed to said undergarment body;

at least one illuminating assembly comprising at least one illuminating element, wherein said at least one illuminating assembly is removably attached to said undergarment body exterior surface by a respective illuminating device attachment element of said plurality of illuminating device attachment elements; and an outer garment having an outer garment body, at least a portion of said outer garment body including a light permissive material, said outer garment being worn over said undergarment, positioning said light permissive material of said outer garment body covering said at least one illuminating assembly, wherein light emitting from said at least one illuminating assembly is visible through said light permissive material of said outer garment body.

14. An illuminating garment combination as recited in claim 13, said undergarment body having a shape for one of:

a dress undergarment, wherein said upper opening defines one of a neckline or a bust line and said at least one lower opening defines a hemline, and said dress undergarment is adapted to be worn under said outer garment, wherein said outer garment is a dress, a blouse undergarment, wherein said upper opening defines one of a neckline or a bust line and said at least one lower opening defines a waist hem, and said blouse undergarment is adapted to be worn under said outer garment, wherein said outer garment is a blouse, a blouse undergarment, said blouse undergarment having a tube top shape, wherein said upper opening defines an upper bust line and said at least one lower opening defines a lower bust line hem, and said blouse undergarment is adapted to be worn under said outer garment, a blouse undergarment, said blouse undergarment having a bra shape, wherein said upper opening defines one of a neckline or a bust line and said at least one lower opening defines a lower bust line hem, and said blouse undergarment is adapted to be worn under said outer garment, a skirt undergarment, wherein said upper opening defines a waistline and said at least one lower opening defines a hemline, and said skirt undergarment is adapted to be worn under said outer garment, wherein said outer garment is a skirt, a tutu undergarment, wherein said upper opening defines a waistline and said at least one lower opening defines a hemline, said undergarment body tailored of said fabric arranged extending generally radially outwards from said waistline, and said skirt undergarment is adapted to be worn under said outer garment, wherein said outer garment is a tutu, a pants undergarment, wherein said upper opening defines a waistline and said at least one lower opening defines a pair of hemlines, and said pants undergarment is adapted to be worn under said outer garment, wherein said outer garment is pants, a culottes undergarment, wherein said upper opening defines a waistline and said at least one lower opening defines a pair of hemlines, and said culottes undergarment is adapted to be worn under said outer garment, wherein said outer garment is culottes, a shorts undergarment, wherein said upper opening defines a waistline and said at least one lower opening defines a pair of hemlines, and said shorts undergarment is adapted to be worn under said outer garment, wherein said outer garment is shorts, a panty shaped undergarment, wherein said upper opening defines a waistline and said at least one lower opening defines a pair of hip hemlines, and said panty shaped undergarment is adapted to be worn under said outer garment, a bodysuit shaped undergarment, said bodysuit shaped garment being fabricated of a stretchable material, wherein said upper opening defines one of a neckline or a bust line, and said at least one lower opening defines a pair of hemlines, said bodysuit shaped undergarment comprising a torso covering and at least one of sleeveless, having a sleeve of any length, legless, and having a legging of any length, and said bodysuit shaped undergarment is adapted to be worn under said outer garment or a unitard shaped undergarment, said unitard shaped garment being fabricated of a stretchable material, wherein said upper opening defines one of a neckline or a bust line, and said at least one lower opening defines a pair of hemlines, and said unitard shaped undergarment is adapted to be worn under said outer garment.

15. An illuminating garment combination as recited in claim 13, wherein said plurality of illuminating device attachment elements are spatially arranged about said undergarment material in at least one of:

an array pattern, a vertically aligned array pattern, a horizontally aligned array pattern, a diagonally aligned array pattern, a predetermined pattern representative of a phrase, a predetermined pattern representative of an image, and a random pattern.

16. An illuminating garment combination as recited in claim 13, said outer garment further comprising at least one light permissive feature, wherein said plurality of illuminating assemblies are spatially arranged about said undergarment material to illuminate said at least one outer garment light permissive feature.

17. An illuminating garment combination as recited in claim 13, said undergarment body comprising one primary undergarment body segment and at least one secondary undergarment body segment, wherein said one primary undergarment body segment and said at least one secondary undergarment body segment are adapted to be detachably joined to one another.

18. An illuminating garment combination as recited in claim 13, wherein at least one of said plurality of illuminating device attachment elements is at least one of:

a) a pocket assembled to said undergarment material, b) a strap for receiving and temporarily assembling at least one of said at least one illuminating assembly to said undergarment body, c) a loop for receiving and temporarily assembling at least one of said at least one illuminating assembly to said undergarment body, d) a magnet and a mating magnetically attracted material for temporarily assembling at least one of said at least one illuminating assembly to said undergarment body, and e) a dense hook and loop tape for temporarily assembling at least one of said at least one illuminating assembly to said undergarment body.

19. An illuminating garment combination as recited in claim 13, wherein said at least one illuminating element is one of a light emitting diode (LED), a fluorescent bulb, an electroluminescent element, an incandescent bulb, and a chemiluminescent material.

20. An illuminating garment combination as recited in claim 13, said at least one illuminating assembly further comprising an illumination circuit, wherein said illumination circuit enables illumination of said at least one illuminating element in accordance with at least one of a group of operational modes, wherein said group of operational modes includes:

a continuous emission of light, a flashing emission of light, a sequential emission of light, a color changing emission of light.

* * * * *